US011359263B2

(12) United States Patent
Gummert et al.

(10) Patent No.: US 11,359,263 B2
(45) Date of Patent: Jun. 14, 2022

(54) LEAD-FREE HIGH TENSILE BRASS ALLOY AND HIGH TENSILE BRASS ALLOY PRODUCT

(71) Applicant: Otto Fuchs Kommanditgesellschaft, Meinerzhagen (DE)

(72) Inventors: Hermann Gummert, Viersen (DE); Thomas Plett, Schmallenberg (DE); Björn Reetz, Krefeld (DE)

(73) Assignee: OTTO FUCHS KOMMANDITGESELLSCHAFT, Meinerzhagen (DE)

( * ) Notice: Subject to any disclaimer, the term of this patent is extended or adjusted under 35 U.S.C. 154(b) by 74 days.

(21) Appl. No.: 16/082,511

(22) PCT Filed: May 17, 2017

(86) PCT No.: PCT/EP2017/061815
§ 371 (c)(1),
(2) Date: Sep. 5, 2018

(87) PCT Pub. No.: WO2017/198698
PCT Pub. Date: Dec. 23, 2017

(65) Prior Publication Data

US 2019/0093195 A1 Mar. 28, 2019

(30) Foreign Application Priority Data

May 20, 2016 (DE) ..... 202016102696.2

(51) Int. Cl.
*C22C 9/04* (2006.01)

(52) U.S. Cl.
CPC ..... *C22C 9/04* (2013.01)

(58) Field of Classification Search
CPC ..... C22C 9/04
USPC ..... 420/470–482, 485–490
See application file for complete search history.

(56) References Cited

U.S. PATENT DOCUMENTS

| | | | |
|---|---|---|---|
| 3,923,500 | A | 12/1975 | Kitazawa et al. |
| 4,874,439 | A | 10/1989 | Akutsu |
| 4,995,924 | A | 2/1991 | Akutsu |
| 5,114,468 | A | 5/1992 | Akutsu et al. |
| 5,183,637 | A | 2/1993 | Tanaka et al. |

(Continued)

FOREIGN PATENT DOCUMENTS

| | | |
|---|---|---|
| CH | 223580 | 12/1942 |
| CN | 1092817 A | 9/1994 |

(Continued)

OTHER PUBLICATIONS

ASM Handbook, vol. 18, Friction and Wear of Sliding Bearing Materials, 2017 (reprinted from 1992) (Year: 1992).*

(Continued)

*Primary Examiner* — Alexandra M Moore
*Assistant Examiner* — Austin Pollock
(74) *Attorney, Agent, or Firm* — Polson Intellectual Property Law, PC; Christopher Sylvain; Margaret Polson

(57) ABSTRACT

The present disclosure relates to a lead-free high tensile brass alloy containing 50-65 wt. % Cu; 0.4-3 wt. % Mn; 0.55-3 wt. % Sn; max 1 wt. % Fe; max 1 wt.-% Ni; max. 1 wt.-% Al; max 1.5 wt.-% Si; the remainder being Zn and inevitable impurities, and the sum of elements Mn and Sn being at least 1.3 wt.-% and not more than 6.0 wt.-%.

20 Claims, 15 Drawing Sheets

(56) References Cited

U.S. PATENT DOCUMENTS

| | | | | |
|---|---|---|---|---|
| 5,246,509 | A | 9/1993 | Kato et al. | |
| 5,326,646 | A | 7/1994 | Nakashima et al. | |
| 5,337,872 | A | 8/1994 | Kawamura et al. | |
| 6,793,468 | B2 | 9/2004 | Ojima et al. | |
| 8,435,361 | B2 | 5/2013 | Gaag et al. | |
| 2004/0241038 | A1* | 12/2004 | Hofmann | F16C 33/121 420/472 |
| 2008/0219881 | A1 | 9/2008 | Gaag | |
| 2008/0240973 | A1 | 10/2008 | Gaag et al. | |
| 2009/0022620 | A1 | 1/2009 | Weber | |
| 2009/0092517 | A1 | 4/2009 | Kosaka et al. | |
| 2009/0260727 | A1* | 10/2009 | Oishi | A61P 11/06 148/553 |
| 2011/0132569 | A1* | 6/2011 | Xu | C22F 1/08 164/476 |
| 2011/0211781 | A1 | 9/2011 | Toda et al. | |
| 2011/0214836 | A1* | 9/2011 | Hu | C22C 9/04 164/476 |
| 2012/0020600 | A1 | 1/2012 | Nishimura et al. | |
| 2012/0027638 | A1* | 2/2012 | Kosaka | C22C 9/04 420/471 |
| 2012/0207642 | A1* | 8/2012 | Zeiger | C22F 1/08 420/473 |
| 2013/0330227 | A1 | 12/2013 | Gaag et al. | |
| 2014/0259674 | A1 | 9/2014 | Zhu et al. | |
| 2016/0348215 | A1 | 12/2016 | Gummert et al. | |
| 2017/0051385 | A1 | 2/2017 | Gaag et al. | |
| 2017/0145549 | A1 | 5/2017 | Plett et al. | |
| 2019/0017149 | A1 | 1/2019 | Plett et al. | |

FOREIGN PATENT DOCUMENTS

| | | | | | |
|---|---|---|---|---|---|
| CN | 101709405 | A | | 5/2010 | |
| CN | 101787461 | A | | 7/2010 | |
| CN | 102251142 | A | | 11/2011 | |
| CN | 103589903 | A | | 2/2014 | |
| CN | 103602998 | A | | 2/2014 | |
| CN | 104480345 | A | * | 4/2015 | |
| CN | 104831115 | A | | 8/2015 | |
| DE | 1558817 | | | 4/1970 | |
| DE | 1558467 | | | 7/1970 | |
| DE | 2159482 | A1 | * | 6/1973 | C22C 9/04 |
| DE | 2718495 | A1 | | 11/1978 | |
| DE | 4101620 | A1 | | 7/1991 | |
| DE | 4240157 | A1 | | 6/1994 | |
| DE | 19908107 | A1 | | 8/2000 | |
| DE | 102005059391 | A1 | | 6/2007 | |
| EP | 0407596 | A1 | | 1/1991 | |
| EP | 0709476 | A1 | | 5/1996 | |
| EP | 0872565 | A1 | | 10/1998 | |
| EP | 1281838 | A2 | | 2/2003 | |
| EP | 1712648 | A2 | | 10/2006 | |
| EP | 2135964 | A2 | | 12/2009 | |
| JP | S51115224 | A | | 10/1976 | |
| JP | S52155128 | A | | 12/1977 | |
| JP | 56127741 | | | 6/1981 | |
| JP | S60162742 | A | | 8/1985 | |
| JP | S61117240 | A | | 6/1986 | |
| JP | S62274036 | A | | 11/1987 | |
| JP | H02118041 | A | | 5/1990 | |
| JP | 07310133 | A | * | 11/1995 | |
| JP | 09316570 | A | * | 12/1997 | F16D 41/06 |
| JP | 2001355029 | A | | 12/2001 | |
| JP | 2007332466 | A | | 12/2007 | |
| JP | 2009007673 | A | | 1/2009 | |
| JP | 2009185341 | A | * | 8/2009 | |
| RU | 2382099 | C2 | | 6/2009 | |
| TW | I356851 | B | * | 1/2012 | |
| WO | 2004003244 | A1 | | 1/2004 | |
| WO | 2005071123 | A1 | | 8/2005 | |
| WO | 2012104426 | A2 | | 8/2012 | |
| WO | 2014152619 | A1 | | 9/2014 | |
| WO | 2015046421 | A1 | | 4/2015 | |
| WO | 2015117972 | A2 | | 8/2015 | |
| WO | 2015173291 | A2 | | 11/2015 | |

OTHER PUBLICATIONS

The Prince & Izant Company, "CDA 680 Technical Data Sheet", Retrieved from internet Dec. 3, 2020, https://princeizant.com/uploads/TechnicaLData_Sheets_2016/Copper/CDA_680_RBCuZn-B_TDS.pdf (Year: 2016).*

Copper Development Association; Brasses Overview; Retrieved on Sep. 17, 2021; Wayback Machine Jul. 3, 2016; https://www.copper.org/resources/properties/microstructure/brasses.html (Year: 2016).*

U.S. Appl. No. 16/586,949, filed Sep. 28, 2019. Copy not submitted since available in the USPTO system.

Office Action dated Apr. 13, 2020 in related Chinese application CN201780026760.1.

International Search Report dated Aug. 15, 2017 in parent case PCT/EP2017/061815.

Written Opinion of the International Searching Authority dated Aug. 15, 2017 in parent case PCT/EP2017/061815.

Pending U.S. Appl. No. 15/104,437, filed Jun. 14, 2016.

Pending U.S. Appl. No. 15/119,073, filed Aug. 15, 2016.

Pending U.S. Appl. No. 15/300,234, filed Sep. 28, 2016.

Pending U.S. Appl. No. 16/068,193, filed Jul. 5, 2018.

Kurbatkin II et al: "Effect of 1-5composition on the structure and properties of complex brasses used in the automotive industry", Cvetnye Metally (Tsvetnye Meta, Moskva: Gos. Ob'edinnoe Nauã No-Techniä Eskoe Izdat, Nr. 3, 1. Jan. 1994 (Jan. 1, 1994), Seiten 44-46, XP009186304, ISSN: 0372-2929. 3 pages. English abstract appears on last page.

Weber K et al: "Neuer Pb-freier 1,2,5 Kupferwerkstoff fuer Gleitlageranwendungen in Verbrennungsmotoren und Getrieben", Metall : Fachzeitschrift Für Metallurgie; Technik, Wissenschaft, Wirtsc, GDMB-Verag, Clausthal-Zellerfeld, DE, Bd. 63, Nr. 11, 1. Nov. 2009 (Nov. 1, 2009), Seiten 564-567, XP009157102, ISSN: 0026-0746. 4 pages. English translation of abstract appears on last page.

Office Action dated Jul. 21, 2020 in related Korean application 10-2018-7036988.

Zhang Sheng-Hua et al: "Microstructure and wear properties of some special brasses", Jixie Gongcheng Cailao—Materials for Mechanical Engineering. Jixie Gongyebu Shanghai Cailiao Yanjiusuo. Shanghai. CN. vol. 28. No. 6. Jun. 30, 2004 (Jun. 30, 2004). pages 35-38. XP009175887. ISSN: 1000-3738. Entire article.

Office Action dated Sep. 23, 2020 in related Chinese application CN201780026760.1.

Office Action dated Apr. 1, 2021 in related Indian application 201827039834.

Office Action dated Mar. 23, 2021 in related Japanese application 2018-560790.

Tanabe, Yujiro, "Research on High-Strength Brass (2)", Journal of the Mining and Metallurgical Institute of Japan, vol. 515, pp. 219-231, Mar. 1928. [Concise explanation of relevance satisfied by the English translation of the Japanese Office Action dated Mar. 23, 2021—see MPEP 609.04(a)(III)].

Kinoshita, Toshihiro, "Propeller Materials", Journal of the Japan Society of Mechanical Engineers, vol. 61, No. 477, pp. 1147-1150, Oct. 1958. [Concise explanation of relevance satisfied by the English translation of the Japanese Office Action dated Mar. 23, 2021—see MPEP 609.04(a)(III)].

Office Action dated Jul. 8, 2021 in related Brazilian application 112018070006-1.

Examination Report dated Nov. 9, 2021 in related Chinese application 2018-560790.

* cited by examiner

| Picture 1 | *Si-K* | *Mn-K* | *Fe-K* | *Cu-K* | *Zn-K* | *Sn-L* | *Phase* |
|---|---|---|---|---|---|---|---|
| *Point 1* | 16.07 | 18.18 | 63.50 | | | | Silicide |
| *Point 2* | 15.82 | 20.75 | 48.14 | | | | Silicide |
| *Point 3* | | 1.38 | | 63.34 | 35.29 | | Alpha |
| *Point 4* | | 1.40 | | 62.51 | 36.09 | | Alpha |
| *Point 5* | | 1.68 | | 64.16 | 34.16 | | Alpha |
| *Point 6* | | 1.45 | | 62.27 | 36.28 | | Alpha |
| *Point 7* | | 1.02 | | 62.79 | 36.19 | | Alpha |
| *Point 8* | | 1.75 | | 50.23 | 33.95 | 14.08 | Gamma |
| *Point 9* | | 1.71 | | 52.85 | 42.03 | 3.41 | Beta |
| *Point 9* | 8.00 | 15.38 | 3.98 | 41.10 | 27.89 | 3.65 | Phase mixture |
| *Point 10* | | 1.45 | | 53.60 | 42.10 | 2.85 | Beta |
| *Point 11* | | 1.39 | | 63.86 | 34.76 | | Beta |

| Picture 2 | *Al-K* | *Mn-K* | *Cu-K* | *Zn-K* | *Sn-L* | *Phase* |
|---|---|---|---|---|---|---|
| *Point 1* | | 1.28 | 64.27 | 34.45 | | Alpha |
| *Point 2* | | 1.10 | 62.46 | 36.43 | | Alpha |
| *Point 3* | | 1.52 | 49.81 | 34.63 | 14.04 | Beta |
| *Point 4* | 0.29 | 1.58 | 49.60 | 33.26 | 15.26 | Gamma |
| *Point 5* | 0.39 | 1.35 | 51.97 | 31.46 | 14.84 | Gamma |
| *Point 6* | | 1.42 | 51.32 | 32.60 | 14.66 | Gamma |

CuZn37Mn3Al2Pb5i

| | *Si-K* | *Mn-K* | *Fe-K* | *Cu-K* | *Zn-K* | *Sn-L* | *Phase* |
|---|---|---|---|---|---|---|---|
| *Point 1* | 0.99 | 2.60 | | 60.48 | 35.92 | | Alpha phase |
| *Point 2* | | 1.18 | | 62.29 | 36.54 | | Alpha phase |
| *Point 3* | 1.96 | 4.59 | | 50.41 | 40.73 | 2.32 | Beta phase |
| *Point 4* | 0.37 | 1.79 | | 54.36 | 41.19 | 2.29 | Beta phase |
| *Point 5* | 0.32 | 1.12 | | 63.37 | 35.20 | | Alpha phase |
| *Point 6* | 18.26 | 27.64 | 34.65 | 12.91 | | | Silicide |
| *Point 7* | 15.38 | 19.43 | 36.88 | 18.01 | | | Silicide |
| *Point 8* | 18.33 | 27.94 | 34.70 | 11.83 | | | Silicide |

| | *Si-K* | *Mn-K* | *Fe-K* | *Cu-K* | *Zn-K* | *Sn-L* | *Phase* |
|---|---|---|---|---|---|---|---|
| *Point 1* | | 1.30 | 0.00 | 54.17 | 43.07 | 1.46 | Beta phase |
| *Point 2* | | 1.36 | | 52.94 | 44.62 | 1.08 | Beta phase |
| *Point 3* | 0.18 | 1.19 | | 52.65 | 44.61 | 1.37 | Beta phase |
| *Point 4* | | 1.13 | 0.02 | 54.22 | 43.43 | 1.20 | Beta phase |
| *Point 5* | | 1.05 | 0.00 | 62.33 | 36.62 | | Alpha phase |
| *Point 6* | | 1.01 | 0.18 | 60.09 | 38.71 | | Alpha phase |
| *Point 7* | 21.49 | 16.20 | 59.70 | | | | Silicide |
| *Point 8* | 19.47 | 15.72 | 55.18 | | | | Silicide |
| *Point 9* | 17.92 | 15.93 | 42.68 | | | | Silicide |
| *Point 10* | 17.85 | 13.40 | 63.63 | | | | Silicide |

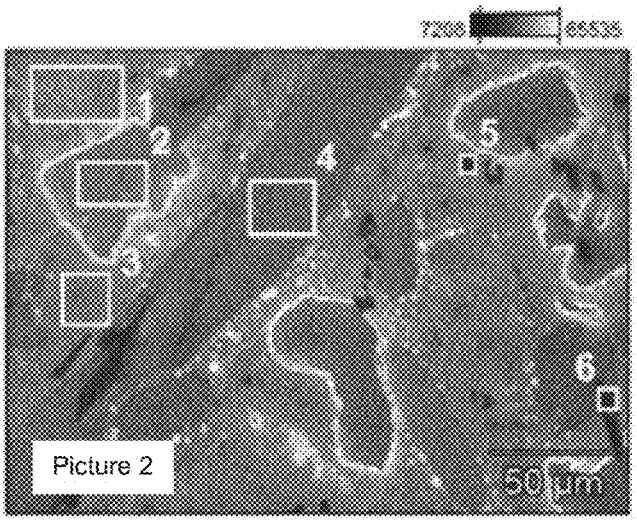
*Fig. 22*
| | *Si-K* | *P-K* | *Mn-K* | *Fe-K* | *Cu-K* | *Zn-K* | *Sn-L* | *Phase* |
|---|---|---|---|---|---|---|---|---|
| *Point 1* | | | 1.00 | | 53.96 | 42.48 | 2.66 | Beta phase |
| *Point 2* | | | 0.72 | | 61.55 | 37.73 | | Alpha phase |
| *Point 3* | | | 1.11 | | 53.30 | 42.97 | 2.62 | Beta phase |
| *Point 4* | | | 0.78 | | 62.10 | 37.12 | | Alpha phase |
| *Point 5* | 21.46 | 0.28 | 52.44 | 14.56 | | | | Silicide |
| *Point 6* | 20.80 | | 52.68 | 9.61 | | | | Silicide |
*Fig. 23*
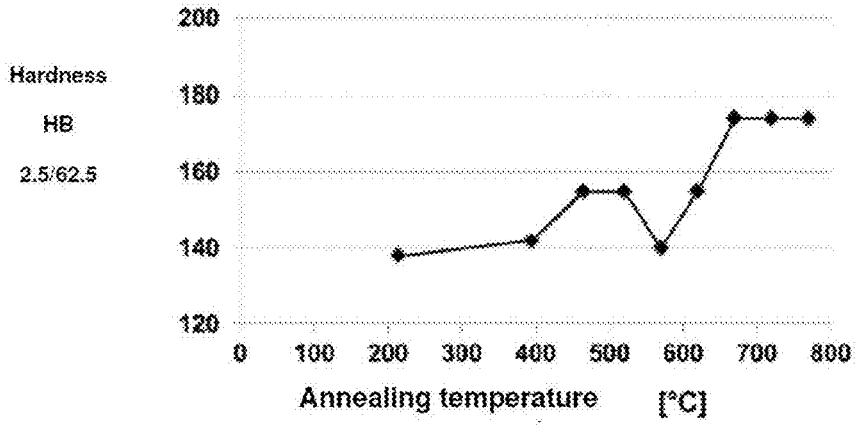
*Fig. 24*

LEAD-FREE HIGH TENSILE BRASS ALLOY AND HIGH TENSILE BRASS ALLOY PRODUCT

BACKGROUND

The present disclosure relates to a lead-free high tensile brass alloy and a product made from a high tensile brass alloy that is subjected to a friction load.

Typical friction applications in a lubricant environment generally require the alloy to have a low coefficient of friction. The coefficient of friction should be adjustable within preset limits for each application, particularly for each pairing friction part, the lubricant, and frictional conditions, such as, for example, contact pressure and relative speed. This applies for piston pin bushings that are subjected to great static and dynamic loads, as well as for synchronizer rings. Further, applications with pairing friction parts at high relative speeds, such as, for example, the axial bearings on a turbocharger, require alloys that ensure reduced heat generation, as well as good heat dissipation from the friction area.

Due to the frictional power and the oil exposure, a tribological layer forms with deposits of lubricant components on the bearing surface. An even, at the same time high, deposit rate of the lubricant components and their breakdown products is required to obtain a stable adsorption layer on the gliding layer.

Moreover, a suitable material for a component that is used in an oil environment, such as, for example, a synchronizer ring or a bearing part for a bearing in such an environment is further characterized by wide-ranging oil tolerances, wherefore the buildup of the tribological layer is for the most part non-sensitive relative to the selection of certain oil additives. A component manufactured from such an alloy must furthermore have good fail-safe characteristics, thereby ensuring an adequate service life even under dry friction conditions.

For components that are exposed to friction loads, it is also important that the employed alloy has adequate strength. Accordingly, a high 0.2% ultimate tensile strength should apply to keep any plastic deformation that occurs when a load is applied as low as possible. Still, such a component should nonetheless feature a certain measure for accommodating plastic deformation above the ultimate tensile strength before failure occurs.

In addition, such components are required to have a special rigidity and tensile strength to increase their resistance to abrasive and adhesive stresses. At the same time, enough toughness is called for to protect against impact stresses. There exists a demand for reducing the incidence of microdefects in efforts of decelerating the growth of defects that emanate from minor cracking. This demand is accompanied by calls for an alloy that exhibits a fracture toughness that is as high as possible and for the most part free of internal stresses.

Suitable alloys for components that are subjected to friction stresses are often high tensile brass varieties that include, in addition to copper (Cu) and zinc (Zn) as the main components, at least one of the alloying elements such as nickel (Ni), iron (Fe), manganese (Mn), aluminum (Al), silicon (Si), titanium (Ti) or chromium (Cr). Particularly silicon brass varieties satisfy these requirements, wherein CuZn31Si1 is a standard alloy for friction applications, such as piston pin bushings. Further disclosures use tin bronzes that contain, aside from tin (Sn) and copper, nickel, zinc, iron and manganese for use in friction or also in mining applications.

WO 2014/152619 A1 teaches a brass alloy for use in turbocharger applications. With 1.5 to 3.0 wt.-% of manganese, the manganese content of the material is very high, while the proportional share of Sn is small measuring less than 0.4 wt.-%. This known brass alloy allows a lead (Pb) content of at most 0.1 wt.-%, whereby this alloy meets the stricter requirements for materials that are free of Pb. However, as a component of an alloy, Pb is favored for incorporation in brass alloys, because this offers benefits regarding chip-forming breakage, whereby machining operations are enhanced. As a corrosion inhibitor, lead, moreover, is typically incorporated in high-strength brass alloys whose alloy products are used in an oil environment. This applies predominantly for such oil environments that are exposed to bioethanol. Bioethanol is comprised in motor vehicle fuels and seeps into motor oil, for example, due to a leaky piston ring or other carry-over impurities. This applies particularly for motor vehicles that mostly travel short distances, whereby the engine does not reach its operating temperature. The same applies for turbocharger bearings that are exposed to an aggressive mixture, due to bioethanol and the waste products of bioethanol that are contained in the exhaust fumes. The result is an acidic environment that forms in the oil. Together, the sulfur contained in the oil and the lead contained in the alloy product form a lead sulfate top layer that acts as a passivation layer and therefore has the effect of a corrosion inhibitor.

The structure of such a brass alloy, which can have distinct phases in the matrix thereof, also influences the resistance to mechanical loads and to corrosion. Brass alloy products with a high proportion of an α-phase are characterized by generally good corrosion fastness, a high level of toughness and elongation at break, as well as good cold-forming properties. It is disadvantageous, on the other hand, that such alloy products have rather poor heat-forming properties and low resistance to abrasion and adhesion. Brass alloy products with β-phase demonstrate high resistance to wear, high strength, good heat-forming properties and low adhesion. The disadvantage of these alloy products is, however, their relatively poor cold-forming properties, their relatively low toughness and their notably inferior resistance to corrosion in contrast to another brass alloy product with α-phase. γ-phase brass alloy products are characterized by their good resistance to corrosion and good mechanical fastness to wear; however, in terms of the disadvantages, they have low toughness and relatively poor forming capacities. Accordingly, it has been demonstrated that, even though each phase offers advantages in one or the other sector, each is also afflicted with disadvantages in other regards that must be accepted.

As indicated previously, corrosion also plays a role in brass alloy products of the kinds that are presently at issue and that are used in oil environments. Accordingly, this means that any alloy that serves for manufacturing the alloy products, which are used, for example, in an oil environment related to an axial bearing, must also satisfy pertinent requirements in this regard.

When exposed to a friction load, a workpiece that is made of a copper alloy will form an adsorption layer that consists primarily of lubricant additives within a short period of exposure to the lubricant. If exposed to a thermomechanical load, a reaction layer made of components from the adsorption layer and alloy components proximal to the surface will form underneath the adsorption layer. The adsorption layer and the reaction layer therein form an outer boundary layer on the copper alloy workpiece, with an inner boundary layer of a thickness of several micrometers underneath thereto. Due to the proximity of the latter to the outer boundary layer, it is influenced by any mechanical loads acting on the surface, as well as by chemical reaction processes. Diffusion and oxidation processes of the substrate alloy in the inner boundary layer can influence the formation of the reaction layer.

Many lubricants contain additives, such as sulfurous and phosphorous additives that can have a corrosive effect in the presence of a corresponding thermomechanical load due to friction contact, which in turn shortens the service life of the workpiece considerably. Copper alloys have been proposed previously in efforts of reducing the corrosive effect of sulfurous components in the lubricant. JP S 60162742 A teaches a copper alloy for alloying a turbocharger that contains relative to proportion by weight 57-61% Cu, 2.5-3.5% Pb, wherein Fe and Zn can be present as impurities. The goal is the formation of a stable CuS layer on the friction surface.

Additives are often added to lubricants with the intention of reducing corrosion on a friction surface and reducing abrasive wear. One example of a corrosion inhibitor (an anti-wear active substance) is, for example, zinc dialkyl dithiophosphate. This addition causes the formation of a surface-protecting phosphate glass in the reaction layer. To this end, there occurs, ideally, an exchange of the ligands between the additive and the alloying elements, as well as a deposition of substrate cations, whereby a load-resistant reaction layer is formed. However, the reaction processes that protect the surfaces depend on the composition of the inner boundary layer of the substrate material. Moreover, additional additives also influence the process because said substances may compete concerning adhesion with the surface-protecting additives in the adhesion layer. The alloy structures, thermal processes of the reaction layer relative to the dissipation of heat and local temperature peaks for processes of forming and breaking down layers are also remarkable. Therefore, depending on the available tribological system and possibly with the participation of corrosion inhibitors, there may even result undesired chemical breakdown processes affecting the friction layer.

SUMMARY

Therefore, proceeding from the foregoing, an aspect of the present disclosure is to propose a high tensile brass alloy that, in addition to being suitable for manufacturing products having the characteristics of high strength and reduced wear, when they are exposed to fiction loads, as well as good fail-safe properties in the presence of deficient lubrication and a simple structure, can be lead-free and/or virtually lead-free at the same time and therefore in compliance with the statutory requirements concerning lead-free products, while still offering resistance to corrosion in an acidic environment.

This is achieved with a lead-free high tensile brass alloy having the following alloying elements:

50-65 wt.-% Cu;
0.4-3 wt.-% Mn, particularly 1-3 wt.-% Mn;
0.55-3 wt.-% Sn;
max. 1 wt.-% Fe;
max. 1 wt.-% Ni;
max. 1 wt.-% Al;
max. 1.5 wt.-% Si;
the remainder being Zn and inevitable impurities, wherein the sum of the elements Mn plus Sn is at least 1.3 wt.-% and at most 6.0 wt.-%.

For purposes of this description, inevitable impurities are those elements that represent individually no more than 0.05 wt.-% and in total no more than 0.15 wt.-% of the alloy.

With this high tensile brass alloy it has been possible to provide more than just a simply designed high tensile brass alloy. The high tensile brass alloy can also provide a means whereby the alloyed products that are manufactured from said alloy have a special high resistance to corrosion, cold- and hot-forming capacities, high mechanical wear resistance, and a high level of toughness. The structure of this high tensile brass alloy contains α- and β-phases. Moreover, the high tensile brass alloy is characterized by a good embedding capacity of the abrasive particles in a load surface; for example, a bearing or a friction surface. Therefore, the alloy products that are manufactured from the high tensile brass alloy is primarily suitable for use in an oil or acidic environment.

The special corrosion resistance that could be established was a surprising finding for this very simply designed high tensile brass alloy because, according to the predominant expert opinion in the field, foregoing the use of lead in forming a corrosion-inhibiting top layer was supposedly impossible. When alloy products made from this alloy are used in an acidic oil environment, the special resistance to corrosion is linked to the content of the elements Mn and Sn. Tests have shown that the issue at hand is not merely the participation of these elements per se; wherein, Mn and Sn constitute alloyed elements, particularly in sum of at least 1.3 wt.-% but not exceeding 6 wt.-%. Tests have further shown that the desired properties do not become adequately manifested in the high tensile brass alloy products when the total of the alloyed elements Mn and Sn is smaller than 1.3 wt.-% or greater than 6.0 wt.-%. This finding was unexpected, specifically as it related to the upper limit. The sum of the elements Mn and Sn is preferably more than 2.0 wt.-% and not more than 4.5 wt.-%.

According to a first embodiment, it is advantageous when the Mn content and the Sn content participate in similar orders of magnitude in constituting the alloy, wherefore, accordingly, the content quantities of these two elements preferably do not deviate by more than 20% to 30% from one to the other. According to a further embodiment, the Mn content is greater than the Sn content, wherein the Mn content is at most twice the Sn content. In this embodiment, the Mn content is preferably about 60-85% greater than the Sn content.

This high tensile brass alloy is a lead-free high tensile brass alloy, particularly in the sense of the End of Life Vehicles Directive.

In the claimed alloy, the Mn content is used to extend the area of existence of the α-phase. This means that Sn, which is also contained in the alloy, is not prematurely bonded in a γ-phase, but it is also available, just like Mn, for forming the desired top layer. In addition, Sn is also needed to achieve the desired fail-safe characteristic. For these reasons, the participation of the elements Mn and Sn in the alloy has been carefully harmonized.

The structure of the high tensile brass alloy products that have been produced from this alloy includes α-phase grains in a β-matrix. The silicides are predominantly Mn—Fe-silicides that are dispersed throughout the structure representing a proportional share of 2 to 4%. The cross-sectional diameter of the silicides is between 5 μm and 20 μm, wherein this value relates to the width of silicides. If the high tensile brass alloy products are extrusion products, the silicides are often stretched into a length-to-width ratio that ranges at times from 10:1 to 15:1.

The good corrosion properties of an alloy product that was manufactured from this alloy were also surprising because, as a matter of principle, Pb was not substituted by another element. Rather, the good corrosion resistance properties were achieved by increasing the Sn content and internally harmonizing the Sn content primarily the element Mn.

The reasons for the improved resistance of a component manufactured from this alloy relative to corrosion stresses also relate to the fact that components manufactured from this alloy have only low electrical conductivity, which is in the range of the conductivity of the reference alloys. Electrical corrosion currents are therefore visibly reduced in contrast to previously known alloys of this kind. The electrical conductivity of high tensile brass alloy products manufactured from this high tensile brass alloy is less than 12 MS/m. Depending on the embodiment of the high tensile brass alloy, the electrical conductivity of the high tensile brass alloy products manufactured therefrom can be as low as under 9 MS/m.

The Sn part is responsible for the necessary fail-safe characteristics that an alloy product manufactured from this alloy is to have as part of a bearing. Accordingly, in the context of the present alloy, the alloyed element Sn has a dual function; namely, the corrosion and fail-safe protection properties of the alloy.

A component manufactured from this alloy and subjected to the usual heat treatment satisfies, first and foremost, mainly the strength values, also relative to the 0.2% yield stress, that are demanded of such components. This aspect is particularly advantageous for a geometric adjustment to the pairing friction parts during the start-up of operations. On an axial bearing therein, these are local microplastic deformations such that the pairing friction parts that act in conjunction become harmonized to each other relative to the surface geometries thereof. Simultaneously, the surface of a component manufactured from this alloy is soft enough to satisfy the requirements for an embedding capacity of foreign particles. Accordingly, it is possible to neutralize foreign particles in a targeted fashion such that they are embedded in the respective surface of the component or workpiece.

Based on the properties of an alloy product manufactured from this alloy as described above, these alloy products are typically parts on axial or radial bearings. According to a preferred embodiment, axial bearing parts were manufactured from this alloy by means of a welding process. Alloy products used as radial bearings parts, on the other hand, are preferably pressed or drawn. A turbocharger bearing is a typical embodiment for the use of a bearing component made from this alloy.

The positive properties of this alloy that have been described above can be further improved when, as provided in a first embodiment, the high tensile brass alloy has the following composition:

56-62 wt.-% Cu;
1.5-2.3 wt.-% Mn, particularly 1.6-2.3 wt.-% Mn;
1.4-2.2 wt.-% Sn, particularly 1.5-2.2 wt.-% Sn;
0.1-0.7 wt.-% Fe, particularly 0.5-0.7 wt.-% Fe;
max. 0.3 wt.-% Ni, particularly max. 0.1 wt.-% Ni;
max. 0.5 wt.-% Al or max. 0.7 wt.-% Al;
0.25-0.85 wt.-% Si;
the remainder being Zn and inevitable impurities.

Regarding this high tensile brass alloy variant, interestingly, it is possible to achieve very comparable results when, according to yet another related embodiment, the high tensile brass alloys comprise the following elements in the proportions as indicated below:

57-61.5 wt.-% Cu;
1.7-2.2 wt.-% Mn, particularly 1.5-2.2 wt.-% Mn;
1.5-2.1 wt.-% Sn;
0.1-0.7 wt.-% Fe, particularly 0.25-0.6 wt.-% Fe;
max. 0.3 wt.-% Ni, particularly max. 0.1 wt.-% Ni
max. 0.5 wt.-% or max. 0.7 wt.-% Al, particularly 0.05-0.25 wt.-% Al;
0.3-0.7 wt.-% Si;
the remainder being Zn and inevitable impurities.

Also having, according to a further variant of a high tensile brass alloys, the following elements in the proportions as indicated below:

57-61.5 wt.-% Cu;
1.7-2.2 wt.-% Mn, particularly 1.5-2.2 Wt.-% Mn;
0.6-1.2 wt.-% Sn;
0.1-0.7 wt.-% Fe, particularly 0.25-0.6 wt.-% Fe;
max. 0.1 wt.-% Ni;
max. 0.5 wt.-% or max. 0.7 wt.-% Al, particularly 0.05-0.25 wt.-% Al;
0.3-0.7 wt.-% Si;
the remainder being Zn and inevitable impurities.

While the Mn and the Sn contents are about in the same order of magnitude in the first variant of a high tensile brass alloy, in the second variant of a high tensile brass alloy of this type, the Mn content is visibly greater than the Sn content. In the first-mentioned variant of a high tensile brass alloy, the ratio of Mn relative to Sn is between 1.15 and 0.95, particularly between 1.1 and 0.97. In this variant of a high tensile brass alloy, the Mn content is preferably only minimally greater than the Sn content, particularly, preferably about 9-12% greater. For the above-captioned second variant of a high tensile brass alloy, the ratio of the alloying elements Mn and Sn is preferably adjusted in such a manner that the ratio of Mn relative to Sn is in the range of 1.9 to 1.65, particularly in the range of 1.82 to 1.74. Relative to this variant of a high tensile brass alloy, the emphasis rests on the higher Mn content relative to the Sn content.

In the previously described variants of a high tensile brass alloy, the Fe content is preferably 0.3-0.5 wt.-%.

In these two variants of the high tensile brass alloy, the proportional share of the $\alpha$-phase is 50 to 70%, such that the proportional share of the $\beta$-phase represents 30 to 50%. The proportional share of the silicides has been subtracted out from this information.

A further type of the high tensile brass alloy as claimed in claim 1 comprises the following elements:

52-59 wt.-% Cu;
1.5-2.7 wt.-% Mn;
0.55-2.5 wt.-% Sn;
0.1-1 wt.-% Fe;
max. 0.3 wt.-% Ni, particularly max. 0.1 wt.-% Ni;
max. 0.3 wt.-% or max. 0.7 wt.-% Al;
max. 0.2 wt.-% Al;
0.15-1 wt.-% Si;
the remainder being Zn and inevitable impurities.

This type of high tensile brass alloy can also be subdivided into two variants that have identical alloying properties, in principle. A first variant of such an alloy has a Mn content that is visibly higher than the Sn content of the variant, and has the following composition:

53-59 wt.-% Cu;
1.6-2.5 wt.-% Mn;
0.5-1.4 wt.-% Sn;
0.1-1 wt.-% Fe;

max. 0.3 wt.-% Ni, particularly max. 0.1 wt.-% Ni;
max. 0.3 wt.-% or max. 0.7 wt.-% Al, max. 0.2 wt.-% Al;
0.15-1 wt.-% Si;
the remainder being Zn and inevitable impurities.

In a further variant, the Mn content is about the same as the Sn content. This alloy has the following composition with the proportional shares of the elements that participate in the alloy as seen below:

53-59 wt.-% Cu;
1.6-2.5 wt.-% Mn;
1.2-2.2 wt.-% Sn;
0.1-1 wt.-% Fe;
max. 0.1 wt.-% Ni;
max. 0.3 wt.-% or max. 0.7 wt.-% Al, max. 0.2 wt.-% Al;
0.15-1 wt.-% Si;
the remainder being Zn and inevitable impurities.

In these high tensile brass alloys, the Mn and Sn contents are again harmonized in a special way. In the first variant of a high tensile brass alloy, where the Mn content is markedly higher than the Sn content, the ratio of Mn and Sn is in the range between 1.9 to 1.65, preferably in the range of 1.85 and 1.7. In the second variant of a high tensile brass alloy of this type, the ratio of the Mn and Sn contents is more even. Preferably, the ratio of Mn to Sn in this variant is in the range between 1.25 and 1.0, particularly between 1.18 and 1.1.

The previously mentioned high tensile brass alloys can contain Pb; however, preferably, they only have a maximum content of 0.2 wt.-% or better yet only a maximum content of 0.1 wt.-%. In the latter instance, such a high tensile brass alloy is considered lead-free in the sense of the End of Life Vehicles Directive.

In another embodiment of this high tensile brass alloy, Pb is not an alloyed element that has been actively incorporated in the alloy; instead, it is only incorporated into the alloying melt due to the use of recycling material. The user must exercise care to ensure that the desired Pb maximum content is not exceeded.

In these variants of the alloy, the proportional share of the β-phase as matrix is greater than in the previously described variants. The content of β-phase (matrix) is about 60 to 85%. The α-phase grains that are embedded in the β-phase represent a proportional share of between 15 and 40%. The proportional silicide share has been subtracted out from this information.

Typically, the previously mentioned variants of the high tensile brass alloy consist exclusively of the alloying elements as indicated above. The enumeration of the alloying elements in the high tensile brass alloy and the introduced variants thereof must then be understood as a final enumeration.

A high tensile brass alloy product that has been manufactured from the further type of a variant as described above—the same applies also for the initially described type of an alloy—is characterized by a special aspect documented during the annealing step for hardening the high tensile bass alloy. The special aspect is the fact that a high tensile brass alloy product notably has two hardening stages, each at a different temperature. Between these two hardening temperature ranges there is a temperature range during which, after reaching the first hardening stage, the material of the high tensile brass alloy product re-softens prior to reaching a further temperature increase in the second hardening stage. The first hardening stage starts at about 440° C.-470° C. with a maximum temperature of between 450° C. and 480° C. The second hardening stage starts at about 580° C.-620° C. reaching a maximum temperature at 650° C.-670° C. or higher. The high tensile brass alloy can be adjusted in such a way that the higher temperature hardening maximum has a significantly greater hardness than the first hardening maximum that was reached at a lower temperature. Accordingly, the alloy can be adjusted, for example, in such a way that a first hardening maximum can be reached at a temperature of about 470° C. with a hardness of about 150-160 according to Brinell (HB 2.5/62.5); on the other hand, starting with a temperature of about 650° C., the second hardening maximum having a hardness of about 170 to 180 HB 2.5/62.5 or more is reached. The higher strength during the second hardening stage is associated with the fact that the solid phase precipitations, particularly silicides, have smaller grain sizes at higher annealing temperatures. This can be referred to as precipitation hardening. The temperature window, when interim softening occurs, and the hardness typically drops once again to below 150 HB 2.5/62.5, can be utilized for certain processing steps; for example, when processing the high tensile brass alloy is more beneficially carried out in a warm state as opposed to a cold state. This way, the temperature window between maximum hardening temperatures can also be utilized, for example, for sparing the processing tools.

The high tensile brass alloy of the present disclosure can be used for alloy products that are manufactured and obtained as finished castings, welded parts, finished extrusion press semi-finished products or as compressed and drawn products. If so desired, it is possible to envision a final annealing step for these alloy products.

In terms of their variants, the high tensile brass alloys of this type differ regarding their hot- and cold-forming properties, wherefore the one or the other alloy variant is chosen depending on the planned manufacturing process. The hot- and cold-forming properties of a semi-finished produced manufactured from the alloy notably depend on the proportional copper share and/or the zinc equivalent and the mixture of α/β-phases. This aspect underlines how different forming properties can be adjusted without having to significantly change the alloy, just by relying on variations of said elements. Aside from the different forming properties that can be adjusted for this basic alloy, it is also possible to adjust the same relative to the mechanical strength values (yield stress, ultimate tensile strength) in accordance with the desired requirements. The advantage lies in the fact that this can be achieved with the same basic alloy.

BRIEF DESCRIPTION OF THE DRAWINGS

The present disclosure will be described below based on concrete embodiments. Reference is made therein to the enclosed figures. Shown are as follows:

FIG. 22 shows the image of Picture 2 of FIG. 21, as seen under the scanning electron microscope, with the areas marked that were subjected to EDX analysis, FIG. 23 is a table showing EDX analysis of the specimen points from FIG. 22, FIG. 24 is a hardening diagram of the casting specimen from the fourth alloy.

DETAILED DESCRIPTION

Experiment 1

An alloy having the following composition was cast into specimen pieces in a first test series:

| | Cu | Mn | Sn | Fe | Ni | Al | Si | Zn |
|---|---|---|---|---|---|---|---|---|
| Specimen 1 | 59.5 | 2.0 | 1.8 | 0.4 | 0.05 | 0.05 | 0.5 | Remainder |

Figure 1:
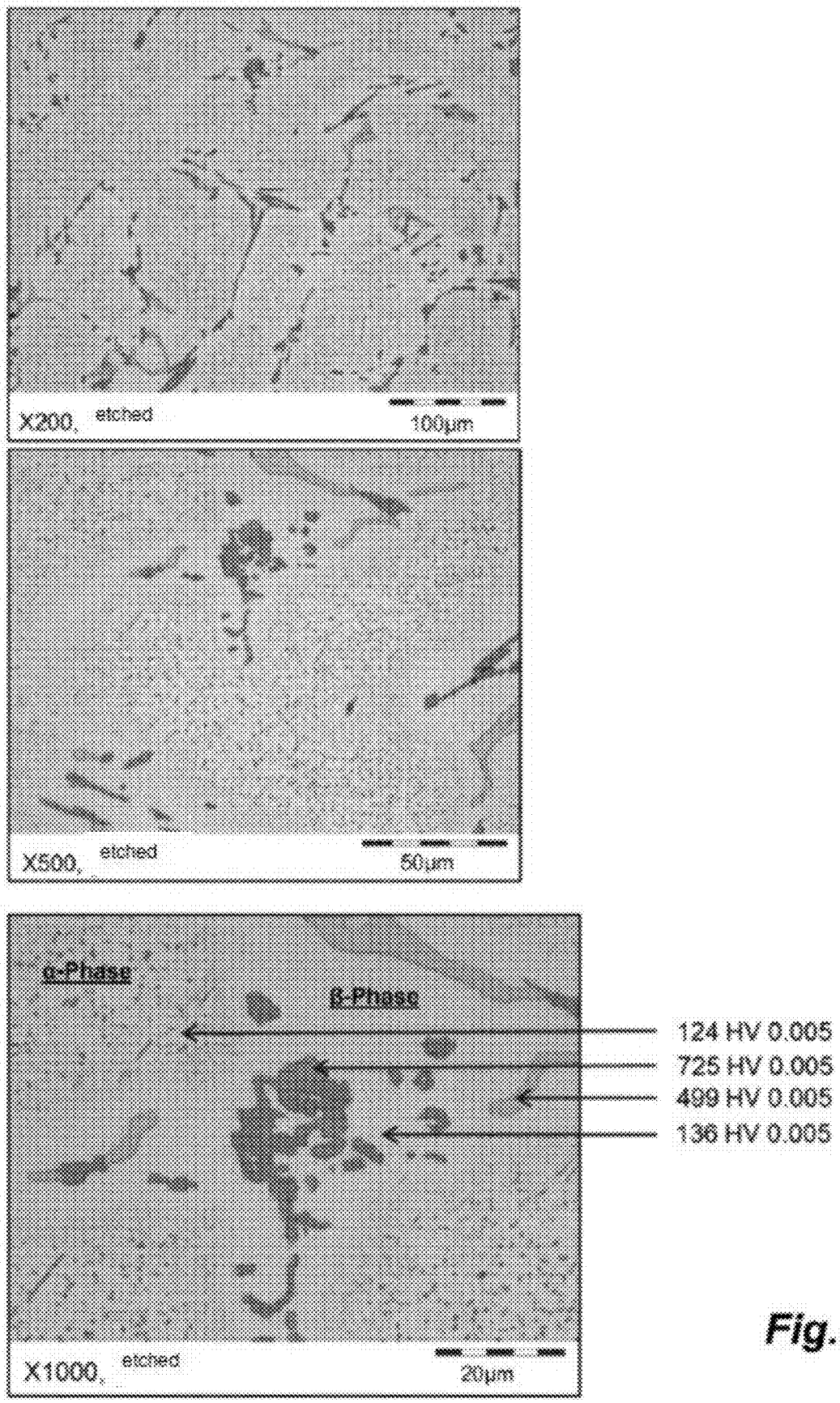
FIG. 1 shows three images of the surface of a first workpiece made from a first alloy as seen under a light microscope.

The light-microscopic images of the specimen casting from FIG. 1 shows an α-β-matrix structure with γ-phase and silicides.

Figure 2:
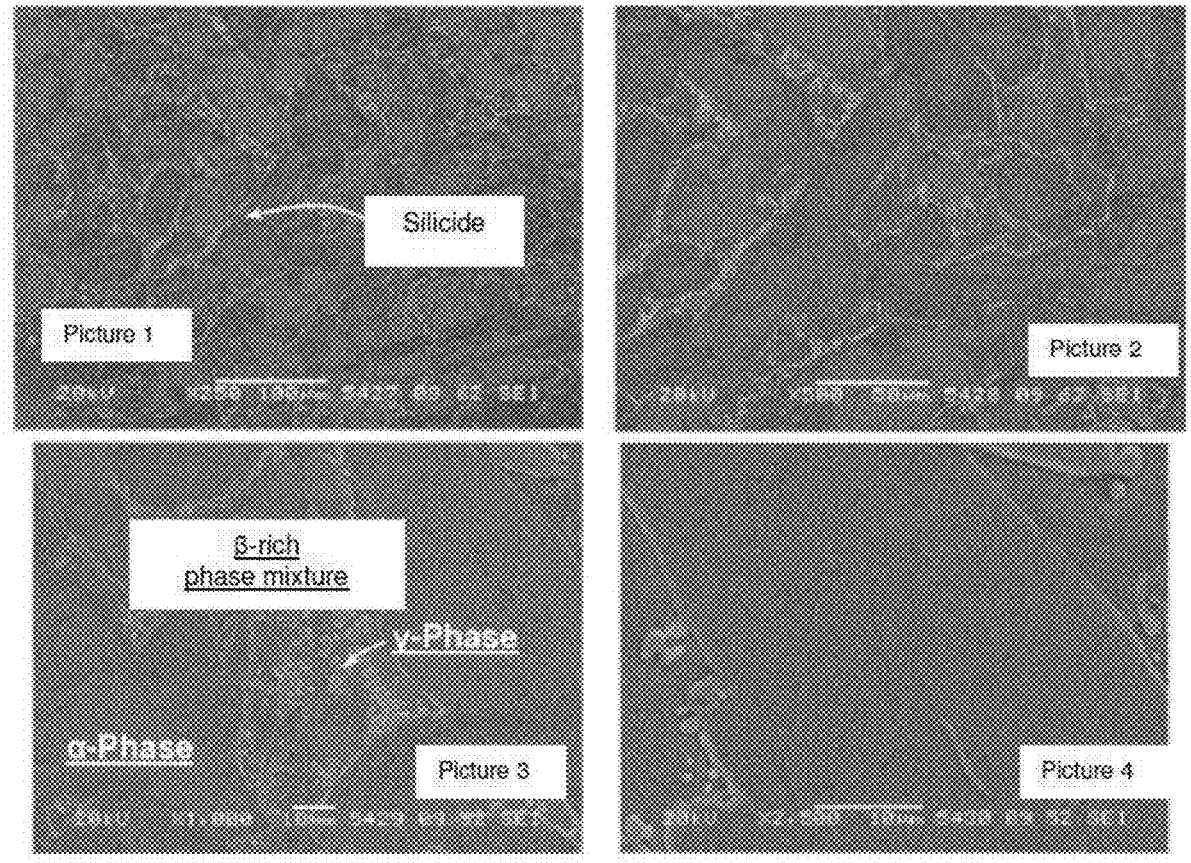
FIG. 2 shows four images of the specimen from FIG. 1, as seen under a scanning electron microscope.

The scanning-electron-microscopic images from FIG. 2 show the minimal size of the precipitations. Said precipitations measure about 10 μm.

Figures 3, 4:
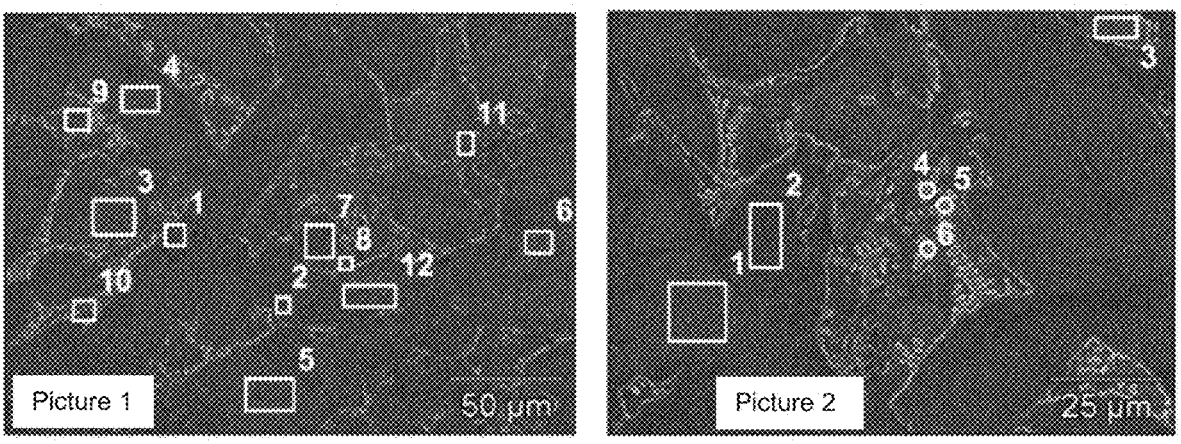
FIG. 3 shows the images of Pictures 2 and 3 in FIG. 2, as seen under the scanning electron microscope, with the areas marked that were subjected to EDX analysis.
FIG. 4 is a table showing EDX analysis of the specimen points from FIG. 3.

The scanning-electron-microscopic images in Pictures 2 and 3 from FIG. 2 undergo EDX analysis. The areas from where the EDX analysis was recorded are marked in FIG. 3 and documented in the table of FIG. 4.

The specimen was subjected to hardening studies, particularly for macro-hardness and micro-hardness. The macro-hardness was measured according to Brinell and yielded a result of 109 HB 2.5/62.5. The micro-hardness was established according to Vickers. A Vickers hardness of 124-136 HV 0.005 was determined for the matrix. The intermetallic phases are by their very nature much harder. A first intermetallic phase had a Vickers hardness of 499 HV 0.005 and a second intermetallic phase a greater hardness of 725 HV 0.005.

This specimen shows an overall very fine structure, high strength and hardness. This specimen shows overall good cold-forming properties.

Together with the reference samples, the specimen underwent corrosion testing.

For purposes of the corrosion test, the samples were immersed half-way in a mixture of motor oil, 20% bioethanol E85 (85% ethanol) and sulfuric acid. The pH was adjusted to 2.6. The tests were performed at a temperature of 60° C. The specimen was kept in this mixture for 2 days, then removed and analyzed under the light microscope.

Figure 5:
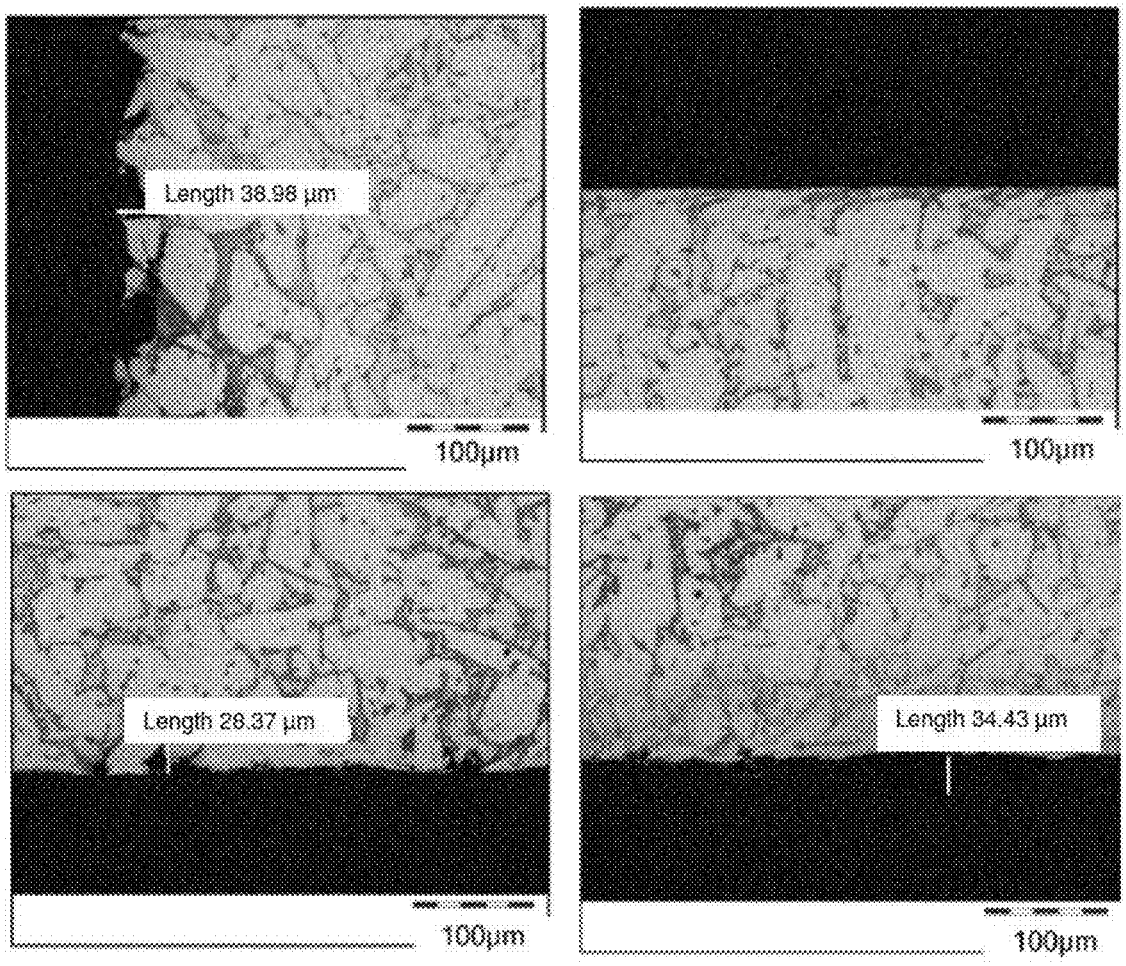
FIG. 5 shows four microphotographs of a specimen from the first alloy of the preceding figures after performing a corrosion test.

FIG. 5 shows each specimen portion that was subjected to corrosion testing. The light-microscopic images from FIG. 5 only show individual instances of a very minor, localized corrosive attacks. This means that deeper-lying material is effectively spared from corrosion. Residues from the top layer are detectable on the surface. It is to be noted that not only the α-phase but also the grain boundaries and the β-phase are resistant to corrosion.

Figure 6:
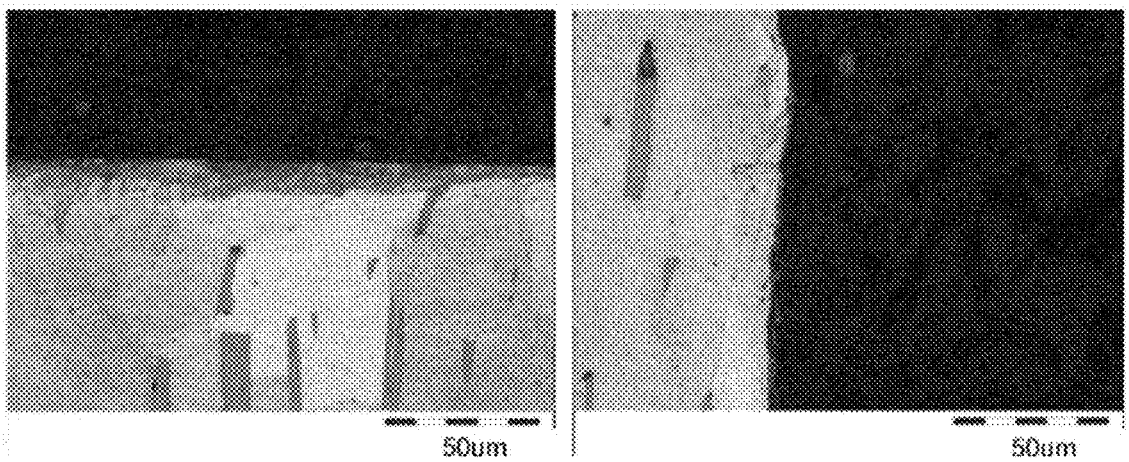
FIG. 6 shows two microphotographs of specimens that underwent the same corrosion test, from a first comparison alloy.

FIG. 6 shows the result from a comparison specimen made of the alloy CuZn37Mn3Al2PbSi that was produced using the same parameters and then tested for corrosion. The localized formation of layers is clearly discernable (particularly in the left picture).

Figure 7:
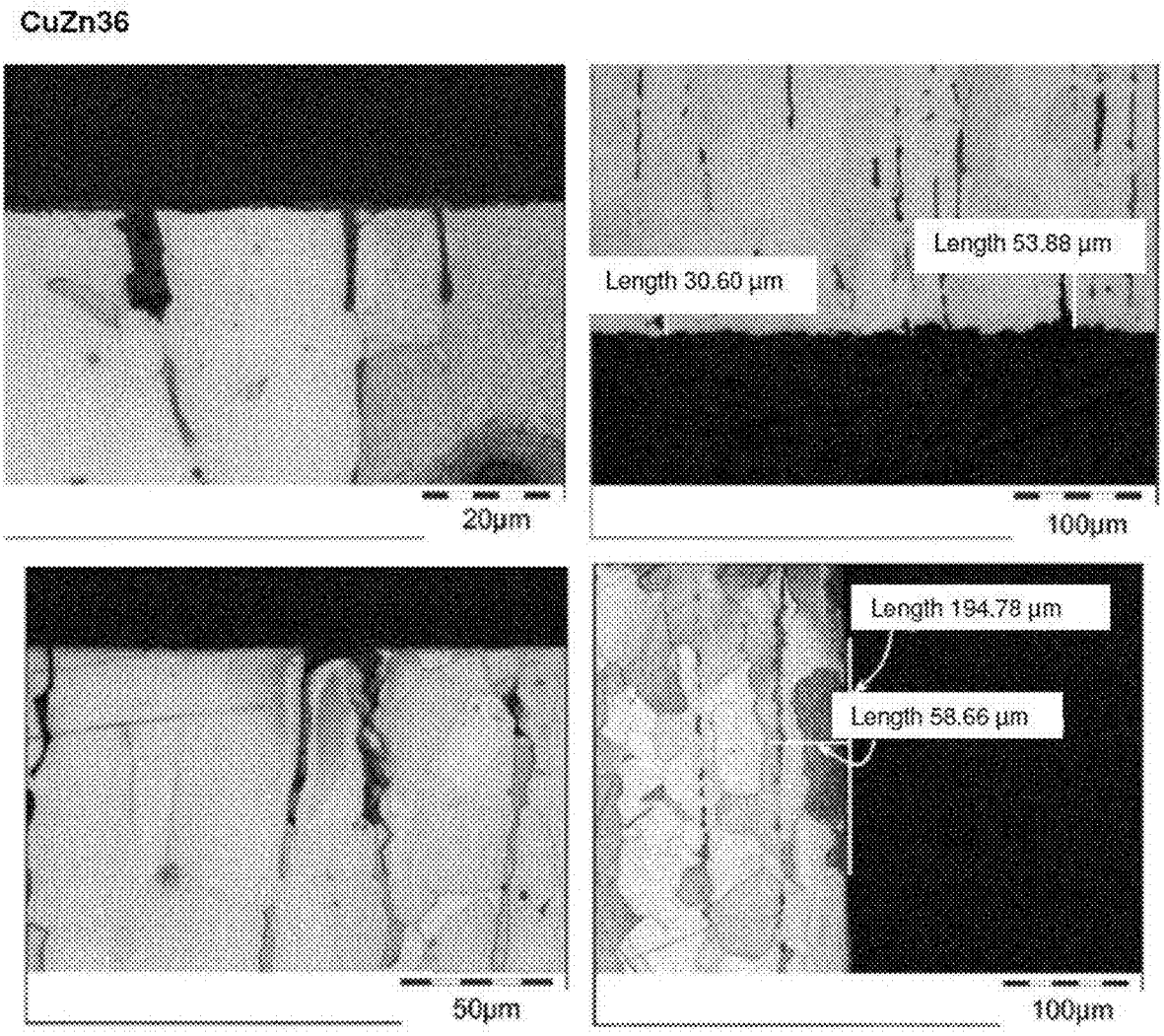
FIG. 7 shows four microphotographs of specimens that underwent the same corrosion test, from a second comparison alloy.

A reference specimen was produced from the alloy CuZn36 with the same parameters and then tested for corrosion (see FIG. 7). This specimen shows the formation of corrosion cracking and plug dezincification.

The picture to the right in the bottom row of FIG. 7 was additionally treated with sulfuric acid.

The electrical conductivity of this specimen is 8 MS/m and corresponds to the electrical conductivity of the reference alloy CuZn37Mn3Al2PbSi. The electrical conductivity is considerably reduced relative to the electrical conductivity of the other reference specimen that has an electrical conductivity of about 15.5 MS/m.

Experiment 2

An alloy having the following composition was cast into specimen pieces in a second test series:

| | Cu | Mn | Sn | Fe | Ni | Al | Si | Zn |
|---|---|---|---|---|---|---|---|---|
| Specimen 2 | 59.5 | 2.0 | 0.9 | 0.4 | 0.05 | 0.05 | 0.5 | Remainder |

Figure 8:
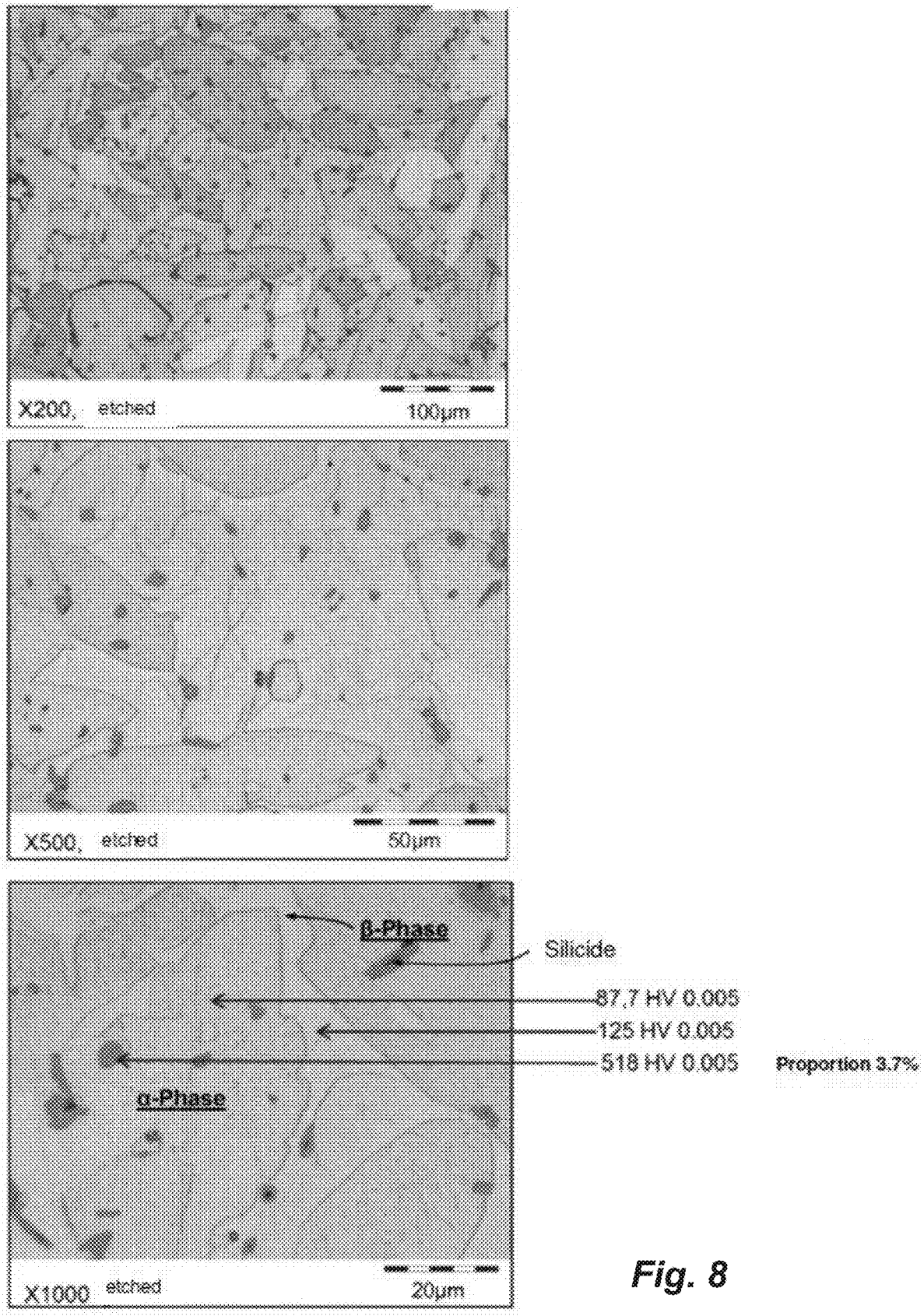
FIG. 8 shows three images of the surface of a specimen, from a second specimen, as seen under the light microscope.

The light-microscopic images of the specimen casting from FIG. 8 show a β-α-matrix with embedded silicides. The share of the intermetallic phases—here: silicides—is about 3.7%.

Figure 9:
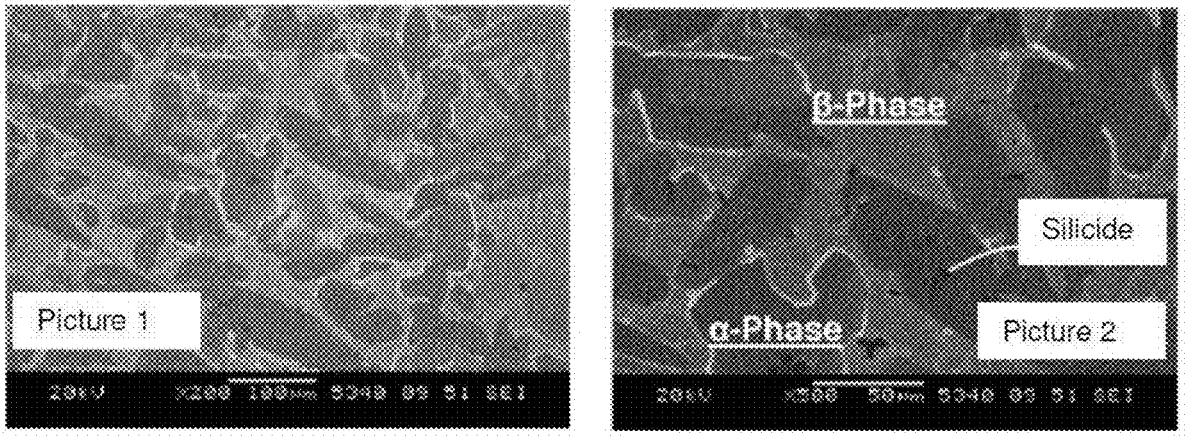
FIG. 9 shows two images of the specimens from FIG. 8, as seen under the scanning electron microscope.

The scanning-electron-microscopic images from FIG. 9 show the small size of the precipitations. The silicides have sizes of between 8 and 12 μm. The α-phase is elongated in the shown scanning plane direction with grain sizes in the longitudinal extension of about 100-120 μm.

Figures 10, 11:
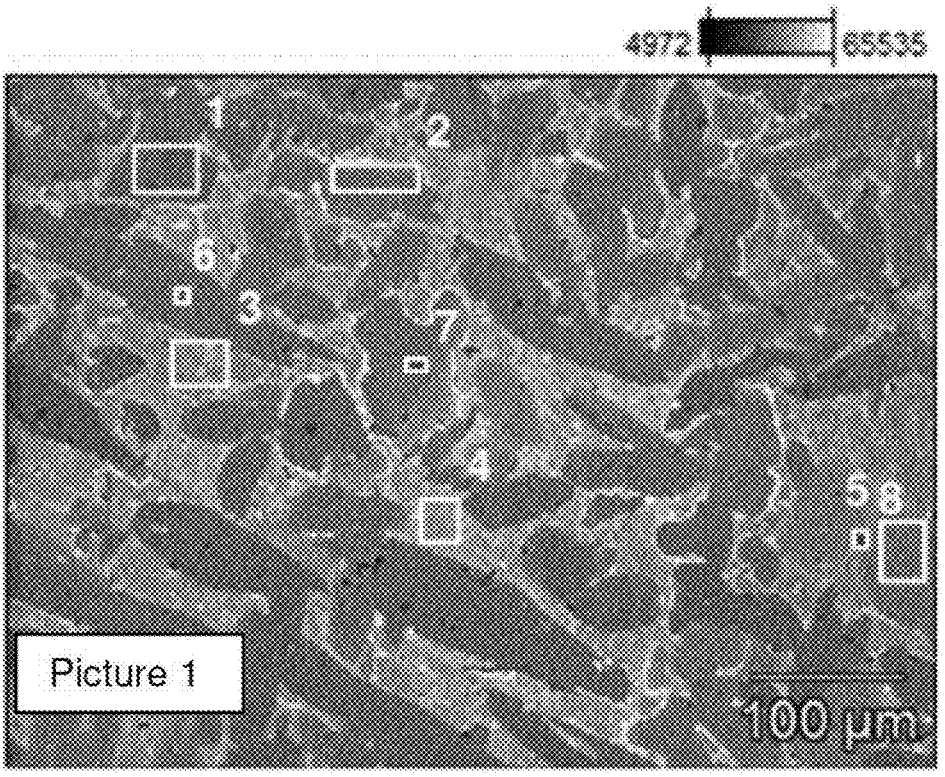
FIG. 10 shows the image of Picture 1 of FIG. 9, as seen under the scanning electron microscope, with the areas marked that were subjected to EDX analysis.
FIG. 11 is a table showing EDX analysis of the specimen points from FIG. 10.

FIG. 10 shows a scanning-electron-microscopic image of areas of the specimens from FIG. 9 (Picture 1). The areas that underwent an EDX analysis have been marked in FIG. 10 and compiled in the table of FIG. 11.

As a result, the finding can be established that manganese is bonded predominantly in the α-phase and β-phase; tin is dissolved in the β-phase.

The specimen was subjected to hardening studies, particularly for macro-hardness and micro-hardness. The macro-hardness was measured according to Brinell and yields a result of 96 HB 2.5/62.5. The micro-hardness was established according to Vickers. The Vickers hardness was determined in the matrix: 88 HV 0.005 in the α-phase and of 125 HV 0.005 in the β-phase. The intermetallic phases are by their very nature much harder. Hardness values of about 518 HV 0.005 were established here.

An extruded specimen also underwent hardness testing, particularly for macro-hardness and micro-hardness. The macro-hardness was measured according to Brinell and yielded a result of 86-100 HB 2.5/62.5. The micro-hardness was established according to Vickers. The Vickers hardness was determined in the matrix: 86 HV 0.005 in the α-phase and of 122 HV 0.005 in the β-phase. The intermetallic phases are by their very nature much harder. Hardness values of about 707 HV 0.005 were established here.

The extruded specimen was subjected to tensile testing to determine the strength values thereof. Testing was done on specimens from the start and the end of the extrusion. This way, it is possible to obtain information concerning the strength values as a function of the press temperature. Typically, the press temperature is somewhat higher at the beginning of the pressing process compared to the pressing at the end of such a specimen extrusion. The tested specimens of the extruded bar yielded these strength values:

| Rp0.2 [N/mm$^2$] | Rm [N/mm$^2$] | A [%] |
|---|---|---|
| 150-220 | 430-470 | 30-40 |

The fluctuation ranges of the preceding information are based on the differences of the position from where the specimens have been taken—beginning and/or end of the press. In this embodiment, the higher tensile values are established for samples taken from the end of the extrusion press, and the lower values are determined based on specimens taken from the beginning of the press. For the elongation at break, this relationship is reversed. The lower values here originate from specimens taken from the end of the extrusion press.

Figure 12:
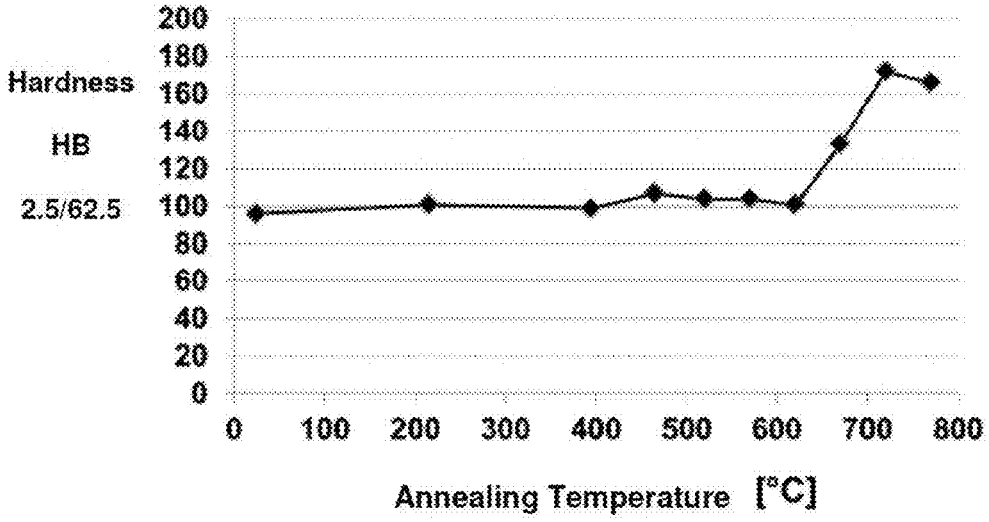
FIG. 12 is a hardening diagram of the casting specimen from the second alloy.

FIG. 12 demonstrates the hardening behavior when the specimens that have been taken from this alloy underwent annealing. The specimens were heated to a temperature so that they were heated throughout, maintained at that temperature and then allowed to cool down under air. The annealing temperature diagram shows that the hardening maximum is reached at about 730° C.

Overall, this specimen shows a very fine structure and high levels of strength and hardness. This specimen also has sufficient cold-forming properties.

The specimen underwent corrosion testing together with reference samples. The corrosion tests were performed in the same manner as described previously in Experiment 1. The same reference samples were reused here as those used in Experiment 1. Reference is made to FIGS. 6 and 7 and the related portions of the description.

Figure 13:
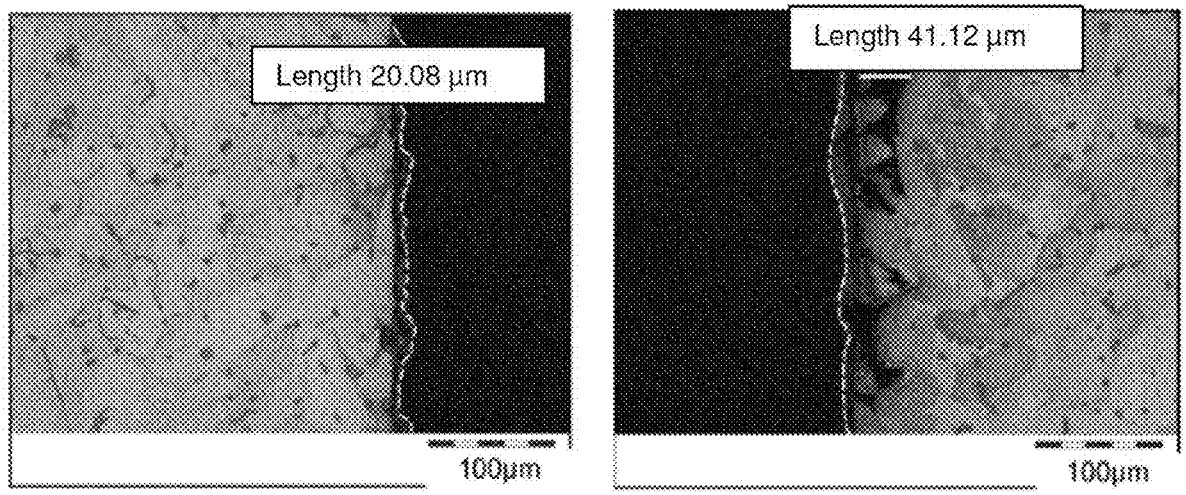
FIG. 13 shows two microphotographs of a specimen from the second alloy after performing a corrosion test.

FIG. 13 shows two light-microscopic photos of the specimen from the second alloy that were taken after the corrosion treatment. The top layer formation can be observed (see left picture). The top layer shows good adhesion, with only isolated instances of minor localized corrosive attacks. This means that the material underneath is effectively spared from corrosion. In this specimen, aside from the α-phase, the grain boundaries and the β-phase also resist corrosion.

The electrical conductivity of this specimen is 8.7 MS/m, corresponding to the electrical conductivity of the reference alloy CuZn37Mn3Al2 PbSi. The electrical conductivity is enormously reduced relative to the electrical conductivity of the other reference specimen, which has an electrical conductivity of about 15.5 MS/m.

Experiment 3

An alloy having the following composition was cast into specimen pieces in a first test series:

| | Cu | Mn | Sn | Fe | Ni | Al | Si | Zn |
|---|---|---|---|---|---|---|---|---|
| Specimen 3 | 55.5 | 2.0 | 0.9 | 0.4 | 0.05 | 0.05 | 0.5 | Remainder |

Figure 14:
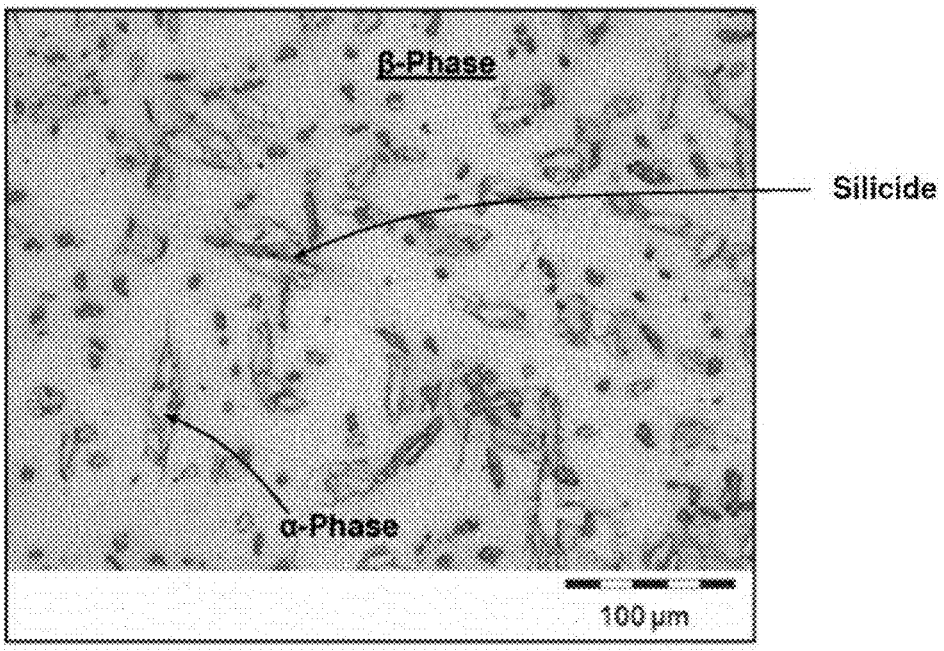
FIG. 14 shows an image of the surface of a first specimen piece from a third alloy, as seen under the light microscope.

The light-microscopic images of the specimen casting from FIG. 14 show a structure made of a β-phase with embedded α-phase and silicides. The silicides are elongated in the shown plane of the section having a width of about 10 μm. The α-phase also includes elongated grains with a longitudinal extension of about 60-70 μm.

This alloy is particularly suited for manufacturing alloy products that are to undergo hot-forming processes.

Figure 15:
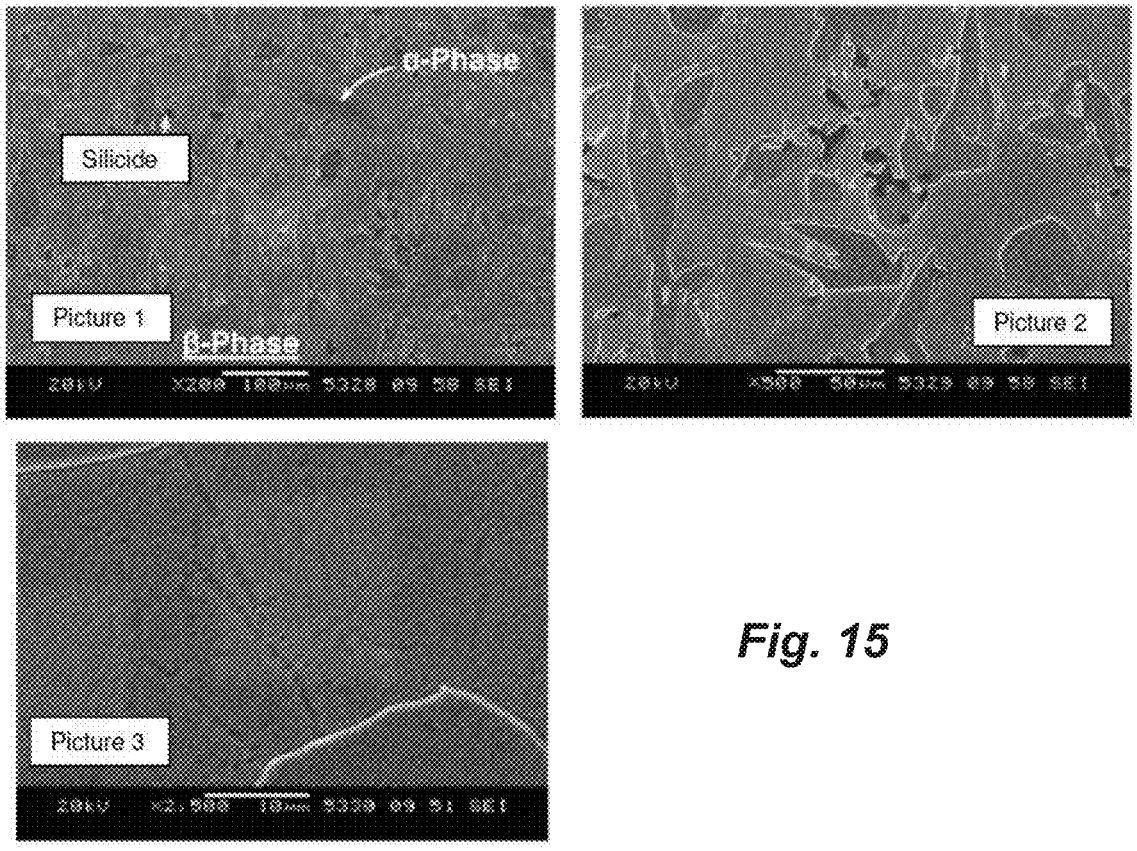
FIG. 15 shows three images of the specimen from FIG. 14, as seen under the scanning electron microscope.

The scanning-electron-microscopic images from FIG. 15 show the structure and the small size of the precipitations.

Figures 16, 17:
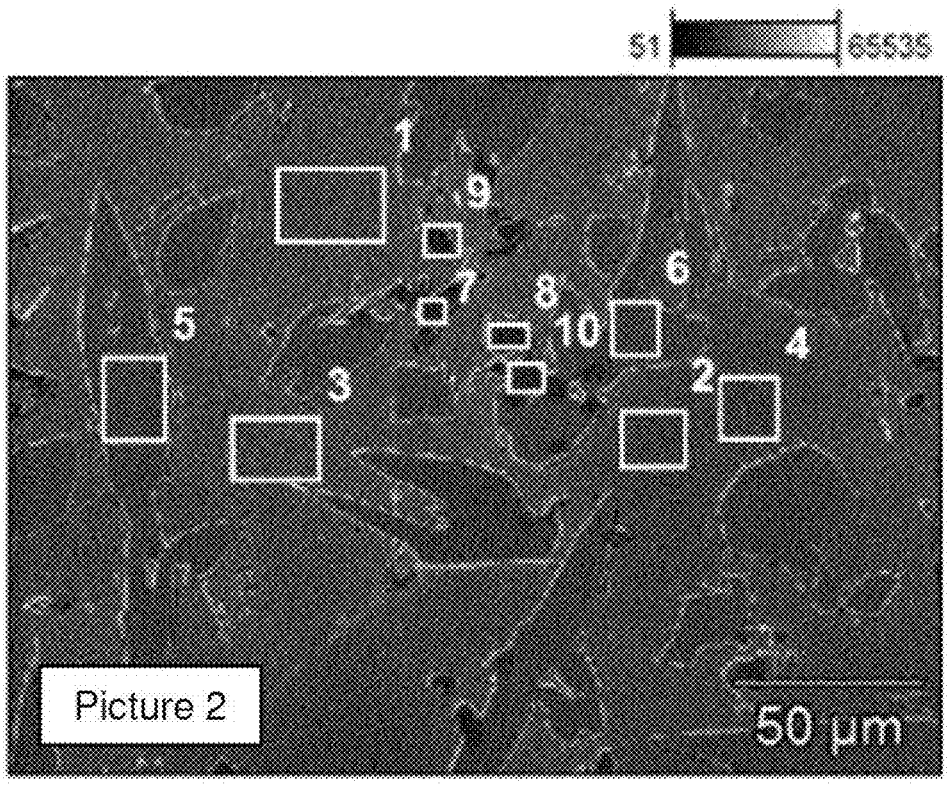
FIG. 16 shows the image of Picture 2 of FIG. 15, as seen under the scanning electron microscope, with the areas marked that were subjected to EDX analysis.
FIG. 17 is a table showing EDX analysis of the specimen points from FIG. 16.

Picture 2 of the scanning-electron-microscopic images from FIG. 15 underwent EDX analysis. The areas where the EDX analysis was recorded have been marked in FIG. 16 and compiled in the table of FIG. 17.

As a result, we can establish the finding that manganese is bonded predominantly in the α-phase and β-phase, while tin is dissolved in the β-phase.

An extruded specimen also underwent hardness testing, particularly for macro-hardness and micro-hardness. The macro-hardness was measured according to Brinell and yielded a result of 113-122 HB 2.5/62.5. The micro-hardness was established according to Vickers. The Vickers hardness was determined in the matrix: 82 HV 0.005 in α-phase and of 155 HV 0.005 in the β-phase. The intermetallic phases are by their very nature much harder. Hardness values of about 980 HV 0.005 were established here.

The extruded specimen was subjected to tensile testing to determine the strength values. Testing was done on samples from the start and the end of the extrusion. This way, it is possible to obtain information concerning the strength values that are a function of the press temperature. Typically, the press temperature is somewhat higher at the beginning of the pressing process compared to the pressing in the end area of such a specimen extrusion. The tested samples of the extruded bar resulted in these strength values:

| Rp0.2 [N/mm²] | Rm [N/mm²] | A [%] |
|---|---|---|
| 240-250 | 530-550 | 20-30 |

The fluctuation ranges of the preceding information are based on the differences of the position from where the specimens were taken—beginning and/or end of the press. In this embodiment, the higher tensile values are established for samples taken from the end of the press, and the lower values are determined based on samples taken from the beginning. Interestingly in this embodiment, the higher values for the elongation at break also originate from the press end. This is unexpected in that the specimens have a higher elongation at break despite also having greater strength. It had been expected that these specimens would behave like those in Experiment 2.

Figure 18:
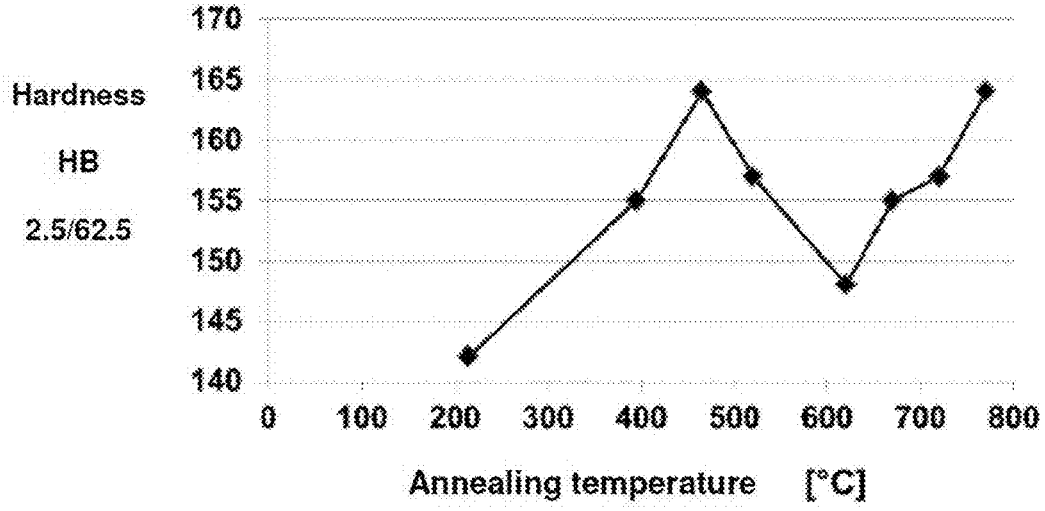
FIG. 18 is a hardening diagram of the casting specimen from the third alloy.

FIG. 18 shows the hardening behavior while annealing the specimen that was manufactured from this alloy. The testing was done in the same manner as described in Experiment 2. Apparently, a hardening maximum is reached at about 470° C. Softening occurs with further temperature increase, followed by renewed increased hardening after about 620° C.

Together with the reference samples, the specimen underwent corrosion testing.

For corrosion testing, the samples were immersed half way into a mixture comprised of motor oil, 20% bioethanol E85 (85% ethanol) and sulfuric acid. The pH was adjusted to 2.6. The experiments were performed at 60° C. The specimen was kept in this mixture for 2 days, then removed and analyzed under a light microscope.

Figure 19:
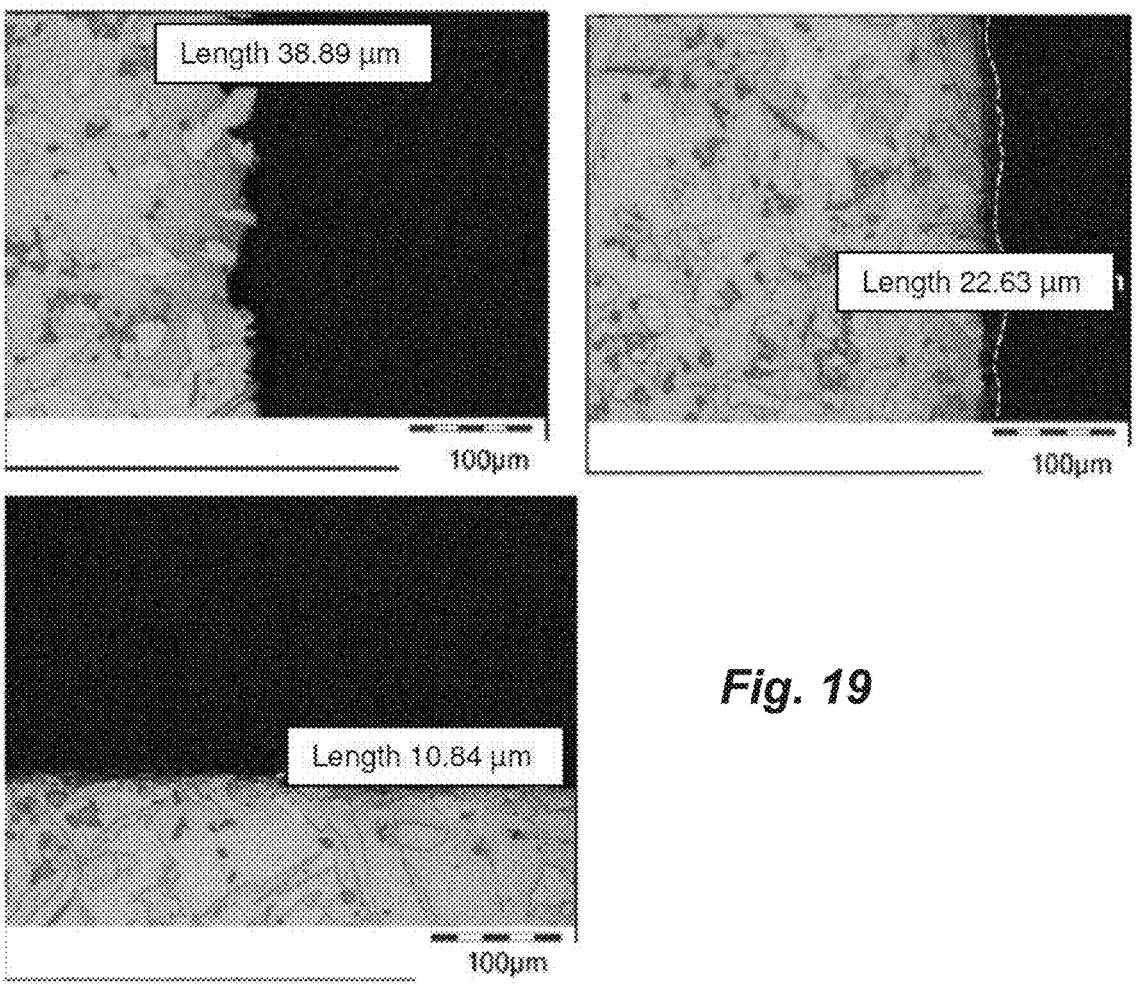
FIG. 19 shows three microphotographs of a specimen from the third alloy after performing a corrosion test.

FIG. 19 shows the portion of the specimen that was subjected to corrosion testing in several microphotographies. The light-microscopic images from FIG. 19 show only very minor, localized corrosive attacks. This means that deeper-lying material has effectively been spared from corrosion. To be noted is the formation of the top layer that protects the deeper-lying areas against corrosion. Said layer is marked in the figure in terms of its thickness. The top layer in FIG. 19 has been traced by a perforated line for better clarity. As shown in the experiments, this top layer has good adhesive quality. It is to be noted that not only the α-phase but also the grain boundaries and the β-phase are corrosion-resistant.

The specimen underwent corrosion testing together with the reference samples, as described previously in Experiment 1. The same reference specimens were used as in Experiment 1. Reference is made to FIGS. 6 and 7 and the related portions of the description.

The electrical conductivity of the specimen from this alloy is 10 MS/m and is therefore of the same order of magnitude as the comparison alloy CuZn37Mn3Al2PbSi.

Experiment 4

An alloy having the following composition was cast into specimen pieces in a second test series:

| | Cu | Mn | Sn | Fe | Ni | Al | Si | Zn |
|---|---|---|---|---|---|---|---|---|
| Specimen 4 | 55.5 | 2.0 | 1.7 | 0.4 | 0.05 | 0.05 | 0.5 | Remainder |

Figure 20:
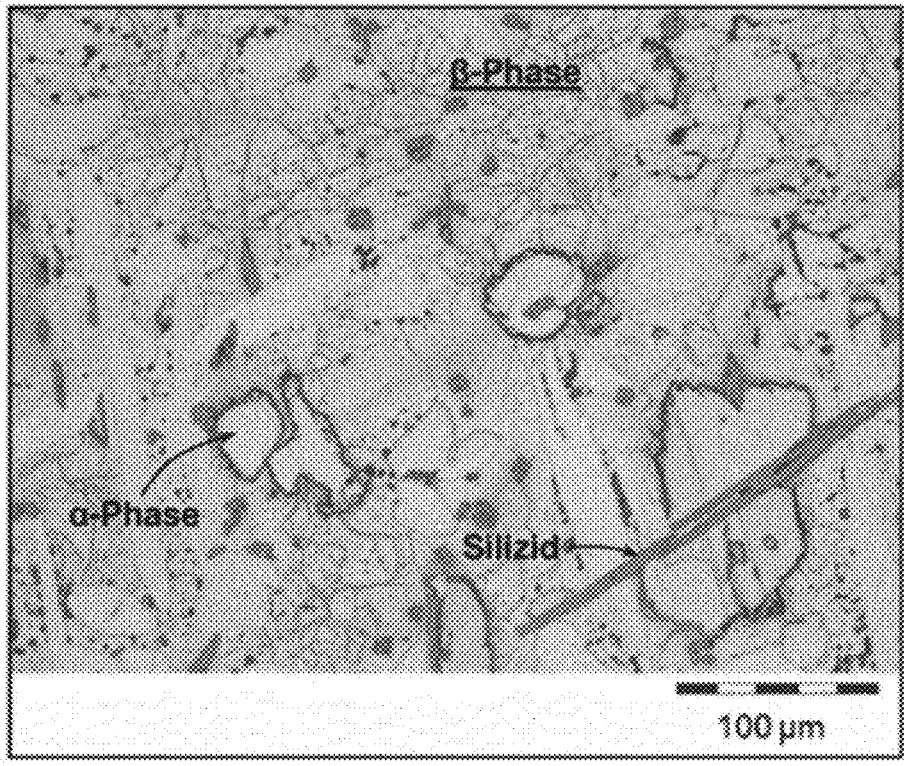
FIG. 20 shows an image of the surface of a specimen from a fourth alloy, as seen under the light microscope.

The light-microscopic image of the casting specimen shown in FIG. 20 shows a structure made up of the β-phase with embedded α-phase and silicides. The silicides have an elongated form in the shown plane of the cut. The width is about 10-20 μm.

This alloy is particularly well suited for the manufacture of alloy products that are envisioned for hot forming processes.

Figure 21:
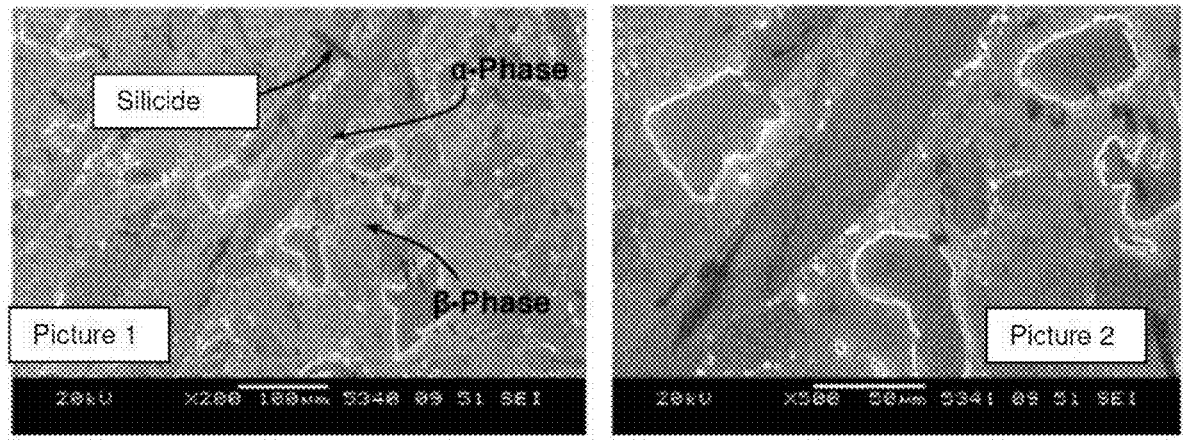
FIG. 21 shows two images of the extruded specimen from FIG. 20, as seen under the scanning electron microscope.

The scanning-electron-microscopic images from FIG. 21 show the discernable relatively small size of the precipitations.

FIG. 22 shows an image as seen from under the scanning electron microscope of areas of the specimen from FIG. 21 (Picture 2). Areas that underwent EDX analysis have been marked in FIG. 22 and compiled in the table of FIG. 23.

As a result, it has been found that manganese is predominantly bonded in α- and β-phases to the silicides, while tin is dissolved in the β-phase.

An extruded specimen also underwent hardness testing, particularly for macro-hardness and micro-hardness. The macro-hardness was measured according to Brinell and yields a result of 121-126 HB HB 2.5/62.5. The micro-hardness was established according to Vickers. In the matrix, a Vickers hardness of 97 HV 0.005 was determined in the α-phase and of 168 HV 0.005 in the β-phase. The intermetallic phases are by to their very nature much harder. Hardness values of about 1070 HV 0.005 were established here.

The extruded specimen was subjected to tensile testing to determine the strength values thereof. Testing was done on samples from the start and the end of the press. This way, was possible to obtain information concerning the strength values as a function of the press temperature. Typically, the press temperature is somewhat higher at the beginning of the pressing process compared to the pressing in the end area of such a specimen extrusion. The tested samples of the extruded bar resulted in these strength values:

| Rp0.2 [N/mm²] | Rm [N/mm²] | A [%] |
|---|---|---|
| 260-270 | 520-550 | 15-25 |

The fluctuation ranges of the preceding information are based on the differences of the position from where the specimen has been taken—beginning and/or end of the press. In this embodiment, the higher tensile values are established for samples taken from the end of the press, and the lower values are determined based on samples taken from the beginning of the press. Interestingly in this embodiment, the higher values for the elongation at break also originate from the specimens at the end of the press. This is unexpected because the samples have a higher elongation at break despite also having greater strength. It was expected that these samples would behave like the samples in Experiment 2.

FIG. 24 shows the hardening behavior during the annealing of the specimen that is manufactured from this alloy. The testing is done in the same way as described previously in Experiment 2. It is clearly discernable that a first hardening maximum is at about 450° C.-510° C. After a softening, subsequent to this hardening maximum, a further hardening maximum is reached at about 670° C.

Figure 25:
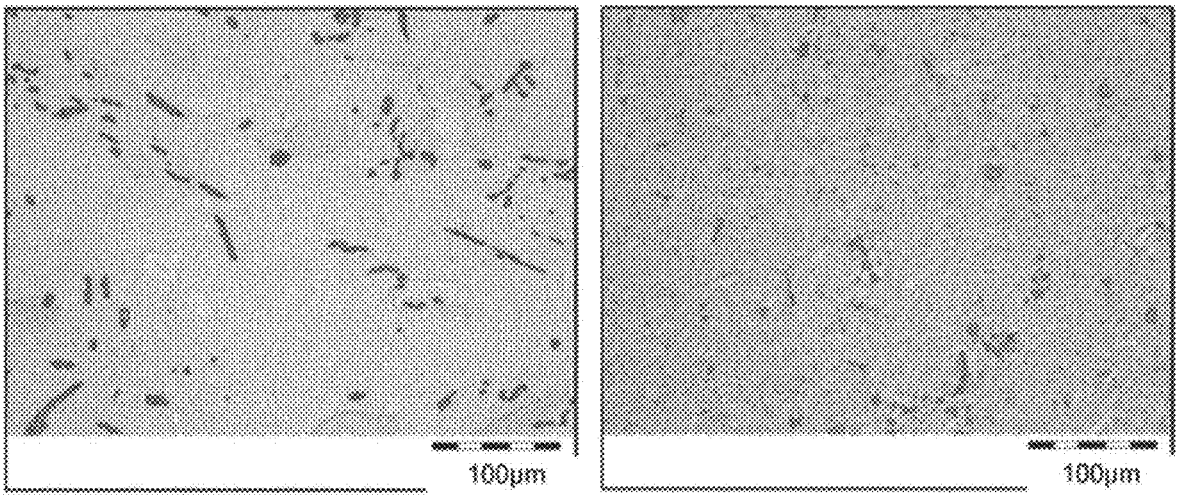
FIG. 25 shows two structural pictures for structure visualization from the fourth alloy, as seen with different hardening maximum values.

FIG. 25 shows a juxtaposition of a structural image of a specimen of an alloy from Experiment 4 in the structural state upon reaching a hardening maximum; particularly, at 520° C. (left picture) and after reaching the second hardening maximum, namely at 770° C. (right picture). After reaching said temperatures, these samples were quenched in water to freeze the annealing temperature structure. The juxtaposition of the two structural images shows that the structure with the higher hardening maximum (right picture) has a much finer grain size. The reason lies in the very fine precipitations of the hardening phases, particularly the silicides. The greater hardness due to the very fine-grained hard-phase precipitations can also be referred to as precipitation hardening.

The specimen underwent corrosion testing together with the reference specimens. The corrosion testing was implemented as explained previously in connection with Experiment 1. The reference specimens were the same as those that were used in Experiment 1. Regarding this point, consult FIGS. 6 and 7 and the related portion of the description for reference.

Figure 26:
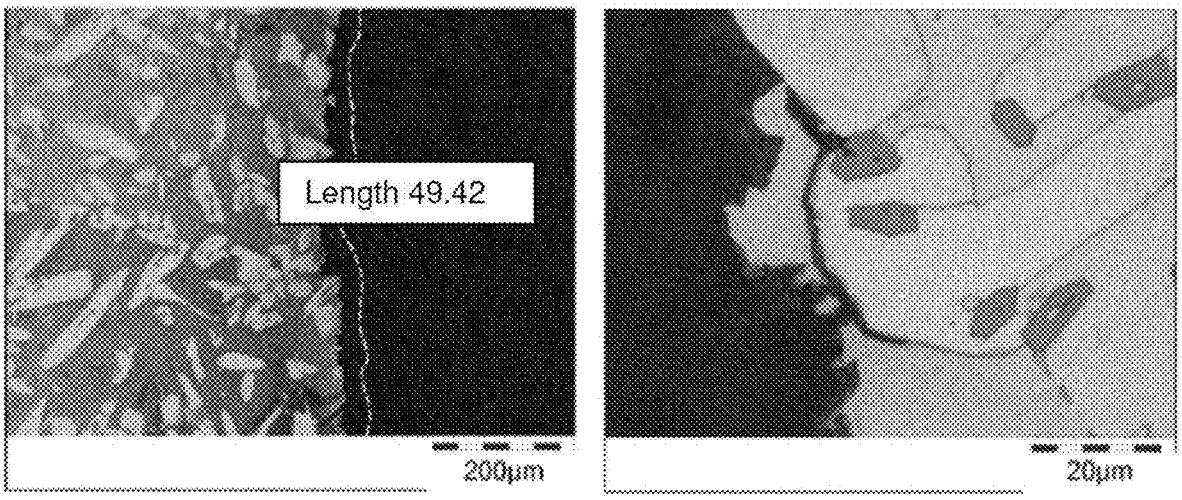
FIG. 26 shows two microphotographs of a specimen from the fourth alloy after performing a corrosion test.

FIG. 26 shows two photos of the specimen from the second alloy after the corrosion treatment as seen under a light microscope. The formation of a top layer can be observed. Deeper-lying layers of the material are thereby effectively spared from corrosion. In the left picture in FIG. 26, the top layer is traced as a perforated line. Aside from the α-phase, in this specimen too, the grain boundaries and the β-phase are also resistant to corrosion.

The electrical conductivity of the specimen from this alloy is 10 MS/m and is therefore of the same order of magnitude as that of the comparison alloy CuZn37Mn3Al2PbSi.

The invention claimed is:

1. A lead-free brass alloy consisting of:
56-62 wt.-% Cu;
1.5-2.3 wt.-% Mn;
1.4-2.2 wt.-% Sn;
0.1-0.7 wt.-% Fe;
max 0.3 wt.-% Ni;
0.25-0.85 wt.-% Si;
the remainder being Zn and inevitable impurities;
wherein the alloy contains a greater proportional share of α-phase grains than β-phase matrix.

2. The lead-free brass alloy of claim 1, having:
57-61.5 wt.-% Cu;
1.7-2.2 wt.-% Mn;
1.5-2.1 wt.-% Sn;
0.1-0.7 wt.-% Fe;
max 0.3 wt.-% Ni;
0.3-0.7 wt.-% Si;
the remainder being Zn and inevitable impurities.

3. The lead-free brass alloy of claim 1, wherein the Fe content is 0.3-0.5 wt.-%.

4. The lead-free brass alloy of claim 1, wherein the Sn content is 1.9-2.1 wt.-%.

5. The lead-free brass alloy of claim 1, wherein the Mn content is 8-15% greater than the Sn content.

6. The lead-free brass alloy of claim 1, wherein the electrical conductivity is less than 12 MS/m.

7. A brass alloy product, manufactured from the lead-free brass alloy of claim 1, wherein the brass alloy product is a bearing part for use with a bearing in an oil environment.

8. The brass alloy product of claim 7, wherein the bearing part is a part for a turbocharger.

9. A lead-free brass alloy consisting of:
57-61.5 wt.-% Cu;
1.7-2.2 wt.-% Mn;
0.6-1.2 wt.-% Sn;
0.1-0.7 wt.-% Fe;
max 0.3 wt.-% Ni;
0.3-0.7 wt.-% Si;
the remainder being Zn and inevitable impurities;
wherein the alloy contains a greater proportional share of α-phase grains than β-phase matrix.

10. The lead-free brass alloy of claim 9, wherein the Sn content is 0.9-1.1 wt.-%.

11. The lead-free brass alloy of claim 9, wherein the Fe content is 0.3-0.5 wt.-%.

12. The lead-free brass alloy of claim 9, wherein the Mn content is 65-85% greater than the Sn content.

13. A lead-free brass alloy consisting of:
53-59 wt.-% Cu;
1.6-2.5 wt.-% Mn;
0.55-1.4 wt.-% Sn;
0.1-0.7 wt.-% Fe;
max 0.2 wt.-% Ni;
0.15-1 wt.-% Si;
the remainder being Zn and inevitable impurities;
wherein the alloy contains a greater proportional share of β-phase matrix than α-phase grains.

14. The lead-free brass alloy of claim 13, wherein the Sn content is 0.6-1.3 wt.-%.

15. The lead-free brass alloy of claim 13, wherein the Mn content is 65-90% greater than the Sn content.

16. A brass alloy product, manufactured from the lead-free brass alloy of claim 13, wherein:
the brass alloy product is extruded and has tensile strength values of an Rp0.2 between 240 and 250 N/mm$^2$ and an Rm between 530 and 550 N/mm$^2$ as well as an elongation at break value of between 20% and 30%,
wherein the brass alloy products with greater ultimate tensile values also have a greater elongation at break value.

17. A lead-free brass alloy consisting of:
53-59 wt.-% Cu;
1.6-2.5 wt.-% Mn;
1.2-2.2 wt.-% Sn;
0.1-0.7 wt.-% Fe;
max 0.2 wt.-% Ni;
0.15-1 wt.-% Si;
the remainder being Zn and inevitable impurities;
wherein the alloy contains a greater proportional share of β-phase matrix than α-phase grains.

18. The lead-free brass alloy of claim 17, wherein the Sn content is 1.3-2.1 wt.-%.

19. The lead-free brass alloy of claim 17, wherein the Mn content is 0-25% greater than the Sn content.

20. A brass alloy product, manufactured from the lead-free brass alloy of claim 17, wherein:
the brass alloy product is extruded and has tensile strength values of an Rp0.2 between 260 and 270 N/mm$^2$ and an Rm between 520 and 550 N/mm$^2$ as well as an elongation at break value of between 15% and 25%,
wherein the brass alloy products with greater ultimate tensile values also have a greater elongation at break value.

* * * * *